US008099004B2

(12) United States Patent
Imamura et al.

(10) Patent No.: US 8,099,004 B2
(45) Date of Patent: Jan. 17, 2012

(54) IMAGE FORMING APPARATUS AND IMAGE FORMING APPARATUS CONTROL METHOD

(75) Inventors: Atsushi Imamura, Shiojiri (JP); Kunihiro Kawada, Matsumoto (JP); Nobuyuki Mizushima, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 573 days.

(21) Appl. No.: 12/342,753

(22) Filed: Dec. 23, 2008

(65) Prior Publication Data

US 2009/0175637 A1 Jul. 9, 2009

(30) Foreign Application Priority Data

Dec. 28, 2007 (JP) ..... 2007-338910
Nov. 12, 2008 (JP) ..... 2008-289429

(51) Int. Cl.
*G03G 15/00* (2006.01)

(52) U.S. Cl. ..... 399/46; 399/60; 399/41; 399/99; 399/249

(58) Field of Classification Search ..... 399/46, 399/60, 71, 99, 249
See application file for complete search history.

(56) References Cited

U.S. PATENT DOCUMENTS

2007/0122181 A1* 5/2007 Kamijo et al. ..... 399/297
2009/0103949 A1* 4/2009 Chiba ..... 399/249
2009/0175641 A1* 7/2009 Mizushima et al. ..... 399/51

FOREIGN PATENT DOCUMENTS

JP 2006-126258 5/2006

* cited by examiner

*Primary Examiner* — Ryan Walsh
(74) *Attorney, Agent, or Firm* — DLA Piper LLP (US)

(57) ABSTRACT

An image forming apparatus includes a first image carrier that carries a first latent image. A first charging section charges the first image carrier. A first exposure section exposes the first image carrier charged by the first charging section. A first developing section develops the first latent image formed on the first image carrier in the first exposure section using a first liquid developer containing a carrier and first toner particles. A first primary transfer section transfers a first image developed in the first developing section onto a transfer medium. A second image carrier carries a second latent image. A second charging section charges the second image carrier. A second exposure section exposes the second image carrier charged by the second charging section.

9 Claims, 15 Drawing Sheets

IMAGE FORMING APPARATUS AND IMAGE FORMING APPARATUS CONTROL METHOD

CROSS REFERENCE TO RELATED APPLICATIONS

This application is based upon and claims the benefit of priority from prior Japanese Patent Applications No. 2007-338910 filed on Dec. 28, 2007 and No. 2008-289429 filed on Nov. 12, 2008, the entire contents of which are incorporated herein by reference.

1. TECHNICAL FIELD

The present invention relates to an image forming apparatus that forms a color image by superposing liquid developer of a plurality of colors and a control method of the image forming apparatus and, more particularly, to an image forming apparatus that carries out a transfer process of transferring a developed image formed on an image carrier onto a transfer medium such as an intermediate transfer belt for each color liquid developer to form a color image onto the transfer medium and a control method of the image forming apparatus.

2. DESCRIPTION OF THE RELATED ART

There have been proposed various types of wet-developing image forming apparatuses that develops a latent image using a high-viscosity liquid developer obtained by dispersing solid toner particles in a solvent to visualize an electrostatic latent image. A developer used in this wet-developing image forming apparatus is prepared by suspending solid content (toner particles) in a high-viscosity electric insulating organic solvent (carrier liquid) such as a silicon oil, mineral oil, or edible oil. The toner particles are so micronized as to have a particle diameter of about 1 μm. By use of such micro toner particles in a wet-developing image forming apparatus, relatively high quality can be achieved as compared to a dry-developing image forming apparatus using toner powder particles having a particle diameter of about 7 μm.

As an image forming apparatus of such a type, there is known one disclosed in, e.g., Patent Document 1: JP-A-2006-126258. In this image forming apparatus, image forming stations of different colors are arranged along a transfer medium such as a transfer belt. In each image forming station, a charging unit, an image writing unit, and a developing unit are arranged around a latent image carrier such as a photosensitive drum. Toner images formed by the respective image forming stations are superposed on the transfer medium, whereby a color image is formed.

Color shift is considered as one of the most serious problem in an image forming apparatus having a plurality of image forming stations. The color shift is caused when transfer positions of respective toner images formed in different image forming stations are relatively shifted from one another and appears as a change in the color tone. To eliminate this problem, the following approach is taken: reference pattern images (hereinafter, referred to as "resist marks") for detecting color shift is previously formed on a transfer medium; the respective resist marks are detected using an optical sensor to acquire position information of the resist marks; and positioning (color shift compensation processing, displacement compensation processing) of respective toner images are performed based on the acquired position information.

The processing of compensating color shift in the image forming apparatus disclosed in JP-A-2006-126258 is described in connection with FIG. 12 and the like of the cited document. As shown in FIG. 12, resist marks YRM (yellow resist mark), MRM (magenta resist mark), CRM (cyan resist mark), and KRM (black resist mark) are formed, as toner images, in this order onto an intermediate transfer belt 41 through an ordinary image forming operation executed immediately after power-on. At this time, image forming timing is controlled so that the resist marks YRM, MRM, CRM, and KRM are formed on a reference position S0. However, as shown in FIG. 12, there is a case where the resist marks MRM, CRM, and KRM are formed at positions shifted from the reference position S0 by Sm, Sc, and Sk, respectively, in the scanning direction X of a laser beam due to an apparatus assembly error. This error can be compensated/eliminated by changing the image forming timing (scanning timing of the optical beam 21) so that image positions are shifted by Sm, Sc, and Sk which are measured by a sensor such as a CCD camera.

SUMMARY

In a wet-developing image forming apparatuses using a liquid developer obtained by dispersing toner particles in a high-viscosity non-volatile carrier liquid, a carrier liquid on the intermediate transfer belt is indispensable for secondary transfer of a toner image onto a recording medium such as a paper in an image forming process. However, a toner image containing the carrier liquid on the intermediate transfer belt has high specularity, which may cause the resist marks to erroneously be detected by a photo-detecting sensor. That is, at the color shift compensation processing time in the image forming apparatus disclosed in Patent Document 1, resist mark detection results obtained by a sensor such as a CCD camera may degrade in accuracy, with the result that accurate position information of the resist marks cannot be obtained, thus preventing accurate color shift compensation.

In order to cope with this problem, a method can be considered in which the carrier liquid on the intermediate transfer belt is removed at the color shift compensation processing time. However, when the carrier liquid on the intermediate transfer belt is removed, solid content ratio in the resist marks is increased. When the resist marks on the intermediate transfer belt proceed in the process downstream and pass through a secondary transfer nip, the solid content ratio in the resist marks is further increased. Then, there arises a new problem that cleaning performance when cleaning the resist mark transferred onto the intermediate transfer belt by means of a cleaning blade is deteriorated.

The present invention has been made to solve the above problem and, according to a first aspect of the present invention, there is provided an image forming apparatus including: a first image carrier; a first charging section that charges the first image carrier; a first exposure section that exposes the first image carrier charged by the first charging section; a first developing section that develops a latent image formed on the first image carrier in the first exposure section using a first liquid developer containing a carrier and first toner particles; a first primary transfer section that transfers a first image developed in the first developing section onto a transfer medium; a second image carrier; a second charging section that charges the second image carrier; a second exposure section that exposes the second image carrier charged by the second charging section; a second developing section that develops a latent image formed on the second image carrier in the second exposure section using a second liquid developer containing a carrier and second toner particles; a second primary transfer section that transfers a second image developed in the second developing section onto a transfer medium; a carrier removal section of a transfer medium that removes the carrier from the first and second images transferred on the transfer medium; a condition storage section that stores a first condition in which the carrier removal amount in the transfer medium carrier removal section is set to a first carrier removal amount and a second condition in which the carrier removal amount in the transfer medium carrier removal section is set to a second carrier removal amount smaller than the first carrier removal amount; an optical sensor that detects the first and second images transferred on the transfer medium, from which the carrier has been removed under the first condition stored in the condition storage section; and a distance calculation section that calculates the distance between the first and second images detected by the optical sensor.

In the image forming apparatus according to the present invention, the transfer medium carrier removal section is a roller, and the rotation direction of the roller differs between the first and second conditions.

The image forming apparatus according to the present invention further includes a second transfer medium carrier removal section that removes a carrier from the first image transferred on the transfer medium.

According to a second aspect of the present invention, there is provided an image forming apparatus including: a first image carrier; a first charging section that charges the first image carrier; a first exposure section that exposes the first image carrier charged by the first charging section; a first developing section that develops a latent image formed on the first image carrier in the first exposure section using a first liquid developer containing a carrier and first toner particles; a first image carrier carrier removal section that removes the carrier from a first image developed in the first developing section; a first primary transfer section that transfers the first image from which the carrier has been removed in the first image carrier carrier removal section onto a transfer medium; a second image carrier; a second charging section that charges the second image carrier; a second exposure section that exposes the second image carrier charged by the second charging section; a second developing section that develops a latent image formed on the second image carrier in the second exposure section using a second liquid developer containing the carrier and second toner particles; a second image carrier carrier removal section that removes the carrier from a second image developed in the second developing section; a second primary transfer section that transfers the second image from which the carrier has been removed in the second image carrier carrier removal section onto a transfer medium; a condition storage section that stores a first condition in which the carrier removal amount in the first image carrier carrier removal section or second image carrier carrier removal section is set to a first carrier removal amount and a second condition in which the carrier removal amount in the first image carrier carrier removal section or second image carrier carrier removal section is set to a second carrier removal amount smaller than the first carrier removal amount; an optical sensor that detects the first image transferred on the transfer medium, from which the carrier has been removed in the first image carrier carrier removal section under the first condition stored in the condition storage section and second image transferred on the transfer medium, from which the carrier has been removed in the second image carrier carrier removal section under the first condition stored in the condition storage section; and a distance calculation section that calculates the distance between the first and second images detected by the optical sensor.

In the image forming apparatus according to the present invention, the first and second image carrier carrier removal sections are rollers, and the rotation direction of the rollers differs between the first and second conditions.

The image forming apparatus according to the present invention further includes a carrier removal section of a transfer medium that removes the carrier from the first and second images transferred on the transfer medium.

The image forming apparatus according to the present invention further includes a second transfer medium carrier removal section that removes the carrier from the first image transferred on the transfer medium.

The image forming apparatus according to the present invention further includes a second first image carrier carrier removal section that removes the carrier from the first image from which the carrier has been removed in the first image carrier carrier removal section; and a second second image carrier carrier removal section that removes the carrier from the second image from which the carrier has been removed in the second image carrier carrier removal section.

In the image forming apparatus according to the present invention, the second first image carrier carrier removal section abuts and separates thereon from the first image carrier, and the second second image carrier carrier removal section abuts and separates thereon from the second image carrier.

Further, according to a third aspect of the present invention, there is provided an image forming apparatus control method, including: charging a first image carrier by a first charging section; exposing the first image carrier charged by the first charging section by a first exposure section to form a latent image; developing the latent image formed on the first image carrier in the first exposure section using a first liquid developer containing a carrier and first toner particles by a first developing section; removing the carrier from a first image developed in the first developing section by a first image carrier carrier removal section; transferring the first image from which the carrier has been removed in the first image carrier carrier removal section onto a transfer medium by a first primary transfer section; charging a second image carrier by a second charging section; exposing the second image carrier charged by the second charging section by a second exposure section to form a latent image; developing the latent image formed on the second image carrier in the second exposure section using a second liquid developer containing the carrier and second toner particles by a second developing section; removing the carrier from a second image developed in the second developing section by a second image carrier carrier removal section; transferring the second image from which the carrier has been removed in the second image carrier carrier removal section onto a transfer medium by a second primary transfer means; and performing image formation on a first recording medium under a first condition in which the carrier removal amount in the first image carrier carrier removal section or second image carrier carrier removal section is set to a first carrier removal amount, while performing image formation on a second recording medium having a rougher surface than that of the first recording medium under a second condition in which the carrier removal amount in the first image carrier carrier removal section or second image carrier carrier removal section is set to a second carrier removal amount smaller than the first carrier removal amount. When detecting the first and second images transferred on the transfer member by an optical sensor and calculating the distance between the first and second images detected by the optical sensor, the first condition is used to perform image formation.

In the image forming apparatus control method according to the present invention, the first and second image carrier carrier removal sections are rollers, and the rotation direction of the rollers differs between the first and second conditions.

The image forming apparatus control method according to the present invention further includes removing the carrier from the first and second images transferred on the transfer medium by a second transfer medium carrier removal section.

The image forming apparatus control method according to the present invention further including removing the carrier from the first image transferred on the transfer medium by a second transfer medium carrier removal section.

The image forming apparatus control method according to the present invention further includes: removing the carrier from the first image from which the carrier has been removed in the first image carrier carrier removal section by a second first image carrier carrier removal section; and removing the carrier from the second image from which the carrier has been removed in the second image carrier carrier removal section by a second second image carrier carrier removal section.

In the image forming apparatus control method according to the present invention, the second first image carrier carrier removal section abuts and separates thereon from the first image carrier, and the second second image carrier carrier removal section abuts and separates thereon from the second image carrier.

According to the present invention, when the color shift compensation mode is executed, the removal amount of the carrier on the intermediate transfer belt is increased as compared to the removal amount in the normal printing operation, so that the position information of the resist marks can be accurately acquired without deterioration in the accuracy of the resist mark detection results obtained by the optical sensor, thereby achieving accurate color shift compensation.

According to the present invention, when the carrier on the intermediate transfer member is removed in order to prevent deterioration in the accuracy of the resist mark detection results obtained by the optical sensor in the color shift compensation mode, the color shift compensation mode is executed under the same condition as in the image forming mode in terms of the carrier removal amount. This prevents deterioration in the cleaning performance when cleaning the resist marks transferred onto the intermediate transfer member by means of the intermediate transfer member cleaning blade.

The following reference embodiment is also possible. That is, an image forming apparatus according to the present invention has: a plurality of image carriers, for respective colors, that carry developed images produced by using a liquid developer containing a carrier and toner particles; an intermediate transfer member that moves in a predetermined direction, onto which the developed images are transferred from the plurality of image carriers; and an optical sensor that detects the developed images transferred to predetermined positions on the intermediate transfer member. The image forming apparatus has a color shift compensation mode that transfers resist marks to predetermined positions on the intermediate transfer member by the plurality of image carriers, detects the resist marks by the optical sensor, calculates a color shift amount between different colors, and compensates the calculated color shift amount and a plurality of image forming modes having different conditions concerning at least the removal amount of the carrier on the intermediate transfer member. The color shift compensation mode is executed under a condition of the same carrier removal amount as in the image forming mode in which the removal amount of the carrier on the intermediate transfer member is largest of all the image forming modes provided in the image forming apparatus.

In the image forming apparatus according to the reference embodiment of the present invention, the plurality of image forming modes are modes that form images on different types of recording media.

The image forming apparatus according to the reference embodiment of the present invention has an intermediate transfer member squeezing roller arranged downstream relative to the plurality of image carriers and changes the peripheral rotation speed of the intermediate transfer member squeezing roller among the plurality of image forming modes to change a condition concerning the removal amount of the carrier on the intermediate transfer member.

The image forming apparatus according to the reference embodiment of the present invention has a plurality of intermediate transfer member squeezing rollers arranged respectively downstream relative to the plurality of image carriers and changes the peripheral rotation speed of the intermediate transfer member squeezing rollers among the plurality of image forming modes to change a condition concerning the removal amount of the carrier on the intermediate transfer member.

The image forming apparatus according to the reference embodiment of the present invention has a plurality of image carrier squeezing rollers abutting the plurality of image carriers respectively at the portions upstream relative to the nips between the intermediate transfer member and respective image carriers and changes the peripheral rotation speed of the image carrier squeezing rollers among the plurality of image forming modes to change a condition concerning the removal amount of the carrier on the intermediate transfer member.

In the image forming apparatus according to the reference embodiment of the present invention, the plurality of image forming modes are modes in which toner consumption amount for use in an image forming process differs from one another.

In the image forming apparatus according to the reference embodiment of the present invention, the moving speed of the intermediate transfer member is not changed among the plurality of image forming modes.

Further, an image forming apparatus control method according to the reference embodiment of the present invention is a control method of an image forming apparatus having: a plurality of image carriers, for respective colors, that carry developed images produced by using a liquid developer containing a carrier and toner particles; an intermediate transfer member that moves in a predetermined direction, onto which the developed images are transferred from the plurality of image carriers; and an optical sensor that detects the developed images transferred to predetermined positions on the intermediate transfer member. The image forming apparatus control method includes a color shift compensation mode that transfers resist marks to predetermined positions on the intermediate transfer member by the plurality of image carriers, detects the resist marks by the optical sensor, calculates a color shift amount between different colors, and compensates the calculated color shift amount and a plurality of image forming modes having different conditions concerning at least the removal amount of the carrier on the intermediate transfer member. The color shift compensation mode is executed under a condition of the same carrier removal amount as in the image forming mode in which the removal amount of the carrier on the intermediate transfer member is largest of all the image forming modes provided in the image forming apparatus.

According to the present invention, when the color shift compensation mode is executed, the removal amount of the carrier on the intermediate transfer belt is increased as compared to the removal amount in the normal printing operation, so that the position information of the resist marks can be accurately acquired without in the accuracy of deterioration of the resist mark detection results obtained by the optical sensor, thereby achieving accurate color shift compensation.

According to the present invention, when the carrier on the intermediate transfer member is removed in order to prevent deterioration in the accuracy of the resist mark detection results obtained by the optical sensor in the color shift compensation mode, the color shift compensation mode is executed under the same condition as in the image forming mode in terms of the carrier removal amount. This prevents deterioration in the cleaning performance when cleaning the resist marks transferred onto the intermediate transfer member by means of the intermediate transfer member cleaning blade.

DETAILED DESCRIPTION OF THE PREFERRED EMBODIMENTS

Figure 1:
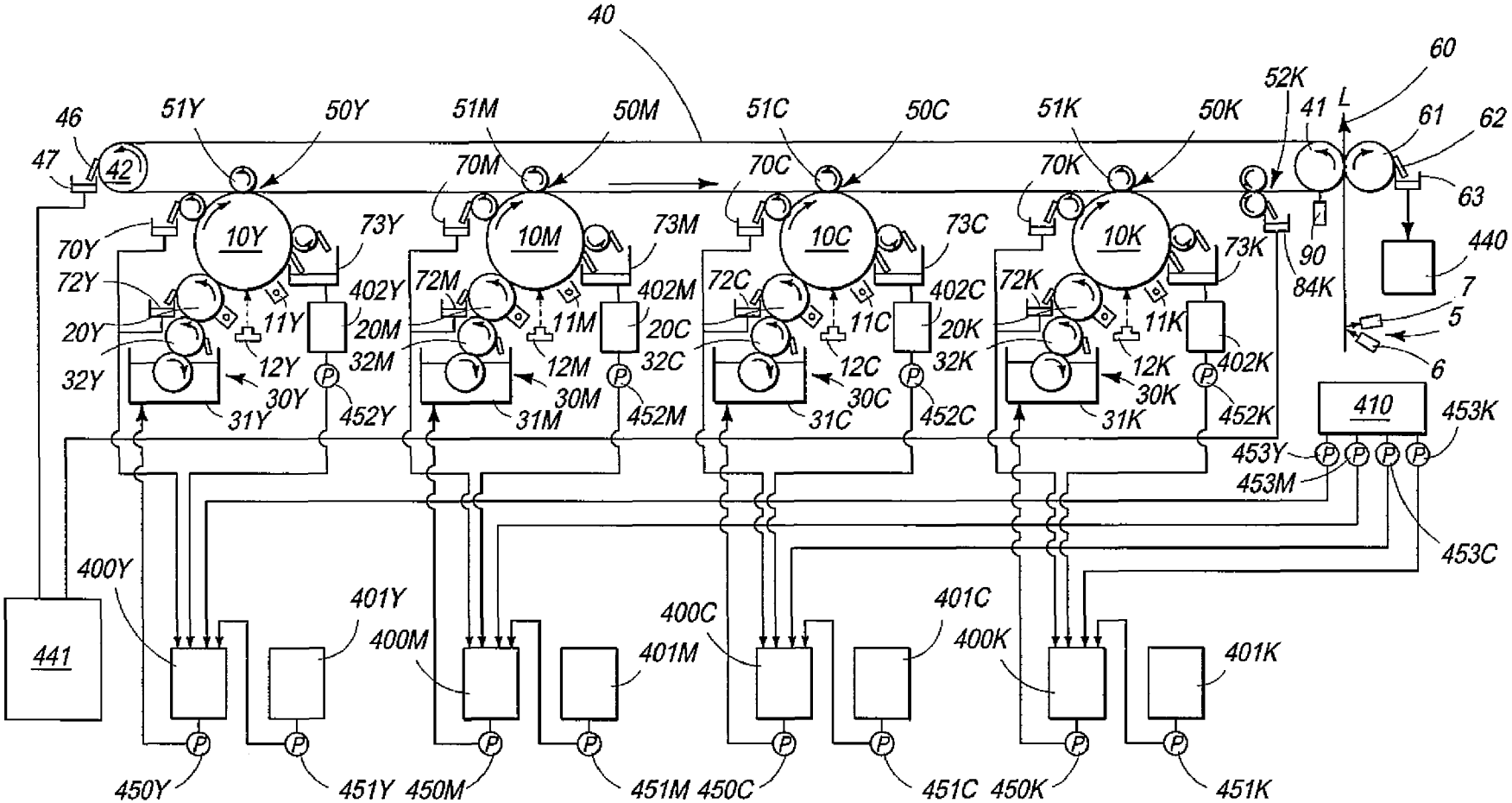
FIG. 1 is a view showing main components constituting an image forming apparatus according to a first embodiment of the present invention.

Embodiments of the present invention will be described below with reference to the accompanying drawings. FIG. 1 is a view showing main components constituting an image forming apparatus according to a first embodiment of the present invention. An image forming apparatus of this embodiment has image forming sections of different colors that are arranged at a middle part of the apparatus. Developing units 30Y, 30M, 30C and 30K are arranged in the lower part of the image forming apparatus and intermediate transfer member 40 and a secondary transfer section (secondary transfer unit) 60 are arranged in the upper part of the apparatus.

The image forming sections are formed respectively by image carriers 10Y, 10M, 10C and 10K, corona chargers 11Y, 11M, 11C and 11K and not shown exposure units 12Y, 12M, 12C and 12K. The exposure units 12Y, 12M 12C and 12K each have an optical system such as a semiconductor laser, a polygon mirror, an F-θ lens. The image carriers 10Y, 10M, 10C and 10K are uniformly electrically charged by the respective corona chargers 11Y, 11M, 11C and 11K and exposed to respective beams of light that are modulated respectively by input video signals by means of the exposure units 12Y, 12M, 12C and 12K to form electrostatic latent images on the electrically charged image carriers 10Y, 10M, 10C and 10K. The developing units 30Y, 30M, 30C and 30K each have developing rollers 20Y, 20M, 20C and 20K, developer reservoirs 31Y, 31M, 31C and 31K storing liquid developer of different colors of yellow (Y), magenta (M), cyan (C) and black (K), anilox rollers 32Y, 32M, 32C and 32K which are application rollers for applying the liquid developer of these colors from the developer reservoirs 31Y, 31M, 31C and 31K to the developing rollers 20Y, 20M, 20C and 20K, and the like and develop the electrostatic latent images formed on the image carriers 10Y, 10M, 10C and 10K by means of the liquid developer of the different colors.

The intermediate transfer member 40 is an endless belt that is wound around a drive roller 41 and a tension roller 42 and is driven to rotate by the drive roller 41, while it is brought into abutting the image carriers 10Y, 10M, 10C and 10K respectively at primary transfer sections 50Y, 50M, 50C and 50K. In the primary transfer sections 50Y, 50M, 50C and 50K, the image carriers 10Y, 10M, 10C and 10K are respectively arranged opposite to primary transfer rollers 51Y, 51M, 51C and 51K with the intermediate transfer member 40 interposed between them. The toner images of the different colors on the image carriers 10Y, 10M, 10C and 10K are sequentially transferred onto the intermediate transfer member 40 one on the other at the respective transfer positions that are the abutting positions between the intermediate transfer member 40 and the image carriers 10Y, 10M, 10C and 10K so as to form a full color toner image.

In the secondary transfer unit 60, a secondary transfer roller 61 is arranged opposite to a belt drive roller 41 with the intermediate transfer member 40 interposed between them. Further, a cleaning unit that includes a secondary transfer roller cleaning blade 62 is also arranged in the secondary transfer unit 60. At the transfer position at which the secondary roller 61 is provided, a single color toner image or full color toner image formed on the intermediate transfer member 40 is transferred onto a recording medium such as a paper, a film or a cloth conveyed along a sheet member conveyance route L.

A fixing unit 90 is arranged on the downstream side of the sheet member conveyance route L. The fixing unit 90 fixes the single color toner image or the full color toner image transferred onto the recording medium such as a paper by fusion.

The tension roller 42 supports the intermediate transfer member 40 together with the belt drive roller 41. A cleaning unit including an intermediate transfer member cleaning blade 46 is so arranged as to be brought into abutting the tension roller 42 at the location where the intermediate transfer member 40 is wound around the tension roller 42.

Figure 2:
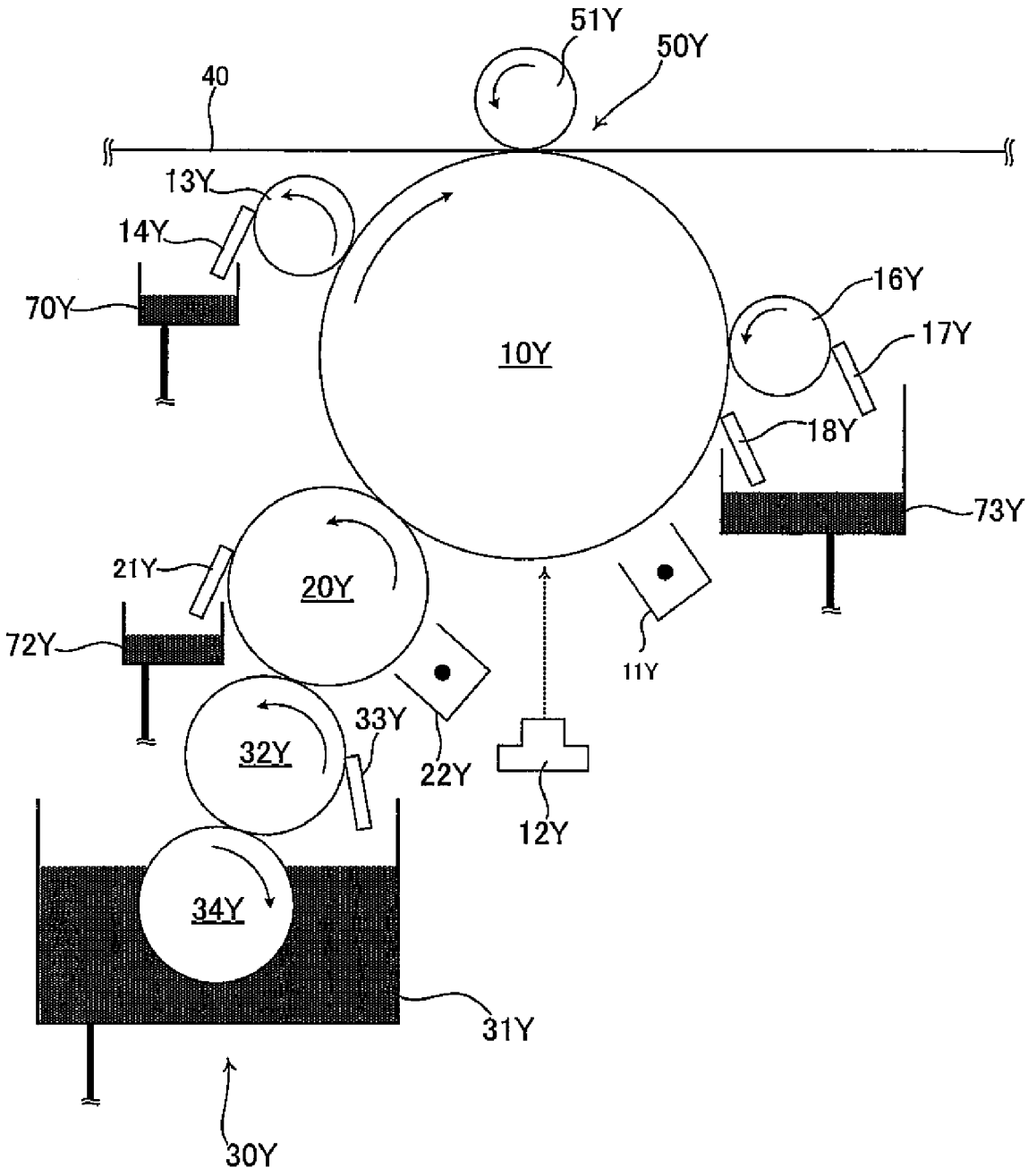
FIG. 2 is a cross-sectional view showing main components of an image forming section and developing unit in the first embodiment of the present invention.

Now, the image forming sections and developing units will be described below. FIG. 2 is a cross-sectional view showing main components of the image forming section and developing unit in the first embodiment of the present invention. Since the image forming sections and developing units of different colors respectively have the same configuration, the image forming section and the developing unit of Y (yellow) will be described below.

In the image forming section, an image carrier cleaning roller 16Y, an image carrier cleaning blade 18Y, a corona charger 11Y, an exposure unit 12Y, a developing roller 20Y of the developing unit 30Y and an image carrier squeezing roller 13Y are arranged along the outer periphery of the image carrier 10Y in the mentioned order as viewed in the sense of rotation thereof.

Reference numeral 17Y denotes an image carrier cleaning roller cleaning blade for cleaning the image carrier cleaning roller 16Y. Further, a cleaning unit including an image carrier squeezing roller cleaning blade 14Y is provided for the image carrier squeezing roller 13Y as an attachment configuration.

Reference numeral 70Y denotes a first image carrier developer collection section for receiving a liquid developer dropped from the image carrier squeezing roller cleaning blade 14Y, and reference numeral 73Y is a third image carrier developer collection section for receiving a liquid developer dropped from the image carrier cleaning roller cleaning blade 17Y and image carrier cleaning blade 18Y. A pipe for evacuating the liquid developer received from the blade is connected to the lower part of the first image carrier developer collection section 70Y. Similarly, a pipe for evacuating the liquid developer received from the blade is connected to the lower part of the third image carrier developer collection section 73Y.

A developing roller cleaning blade 21Y, an anilox roller 32Y, and a toner compression corona generator 22Y are arranged along the outer periphery of the developing roller 20Y in the developing unit 30Y. A restricting blade 33Y for controlling the amount of a liquid developer supplied to the developing roller 20Y is brought into abutting the anilox roller 32Y.

A reference numeral 72Y denotes a developing roller developer collection section for receiving a liquid developer dropped from the developing roller cleaning blade 21Y. A pipe for evacuating the liquid developer received from the blade is connected to the lower part of the developing roller developer collection section 72Y. A liquid developer supply roller 34Y is housed in the developer reservoir 31Y.

The primary transfer roller 51Y of the primary transfer section is arranged at the position opposite to the image carrier 10Y along the intermediate transfer member 40.

Figure 3:
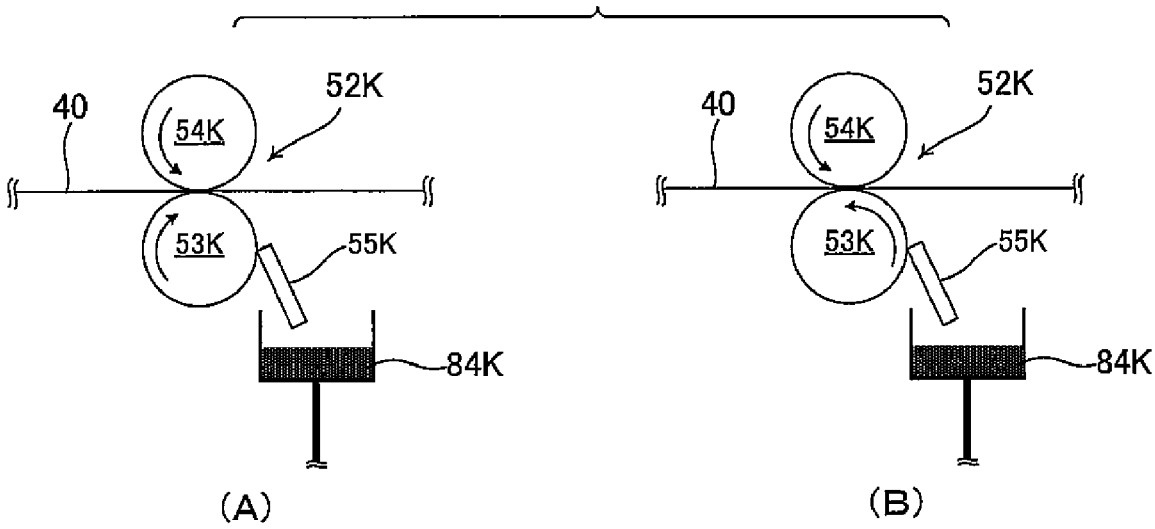
FIGS. 3A and 3B are views showing an intermediate transfer member squeezing unit of the image forming apparatus according to embodiments of the present invention.

FIGS. 3A and 3B are views showing an intermediate transfer member squeezing unit of the image forming apparatus according to embodiments of the present invention. The intermediate transfer member squeezing unit is configured to squeeze the intermediate transfer member 40 at the portion immediately downstream relative to the transfer nip of the image carrier 10K. In the present embodiment, an intermediate transfer member squeezing unit 52K including an intermediate transfer member squeezing roller 53K, a backup roller 54K, and an intermediate transfer member squeezing roller cleaning blade 55K is arranged along the intermediate transfer member 40 at the portion downstream side relative to the developing unit 30K in the moving direction of the intermediate transfer member 40.

Reference numeral 84K is a first intermediate transfer member developer collection section for receiving a liquid developer dropped from the intermediate transfer member squeezing roller cleaning blade 55K. A pipe for evacuating the liquid developer received from the blade is connected to the lower part of the first intermediate transfer member developer collection section 84K.

The image carrier 10Y is a photosensitive drum that is a cylindrical member having a width broader than the width of the developing roller 20Y and having a photosensitive layer formed on the outer peripheral surface thereof. The image carrier 10Y rotates clockwise as shown in FIG. 2. The photosensitive layer of the image carrier 10Y is typically formed by using an organic image carrier or an amorphous silicon image carrier. The corona charger 11Y is arranged at the upstream side relative to the nip portion formed between the image carrier 10Y and the developing roller 20Y in the sense of rotation of the image carrier 10Y. A voltage is applied from a power source (not shown) to corona charge the image carrier 10Y. The exposure unit 12Y is arranged at the downstream side relative to the corona charger 11Y in the sense of rotation of the image carrier 10Y to expose the electrically charged surface of the image carrier 10Y to a laser light and form a latent image on the image carrier 10Y.

The components such as rollers arranged in the earlier stage in the image forming process are assumed to be located on the upstream relative to components such as rollers arranged in the later stage thereof.

The developing unit 30Y includes the toner compression corona generator 22Y for exerting a compaction effect and developer reservoir 31Y storing a liquid developer in which toner is dispersed in carrier liquid to a weight ratio of about 20%.

Further, as described above, the developing unit 30Y includes the development roller 20Y bearing the liquid developer, anilox roller 32Y that functions as an application roller for applying the liquid developer to the developing roller 20Y, restricting blade 33Y for resting the amount of the liquid developer to be applied to the developing roller 20Y, supply roller 34 for supplying the liquid developer to the anilox roller 32Y while agitating and conveying the liquid developer, toner compression corona generator 22Y for making the liquid developer borne on the developing roller 20Y in a compacted state, and developing roller cleaning blade 21Y for cleaning the developing roller 20Y.

The liquid developer contained in the developer container 31Y is not a popular volatile low concentration (about 1 to 2 wt %) and low viscosity liquid developer that is volatile at room temperature and prepared by using Isopar (trademark, available from Exxon) as carrier liquid but a non-volatile high concentration and high viscosity liquid developer that is not volatile at room temperature. More specifically, the liquid developer that is employed for the purpose of the present invention is a high viscosity (about 30 to 10,000 mPa·s) liquid developer prepared by adding solid particles of an average particle size of 1 μm, which are formed by dispersing a coloring agent such as a pigment in thermoplastic resin, in a liquid solvent such as an organic solvent, silicon oil, mineral oil or edible oil with a dispersing agent to make the toner solid concentration equal to about 20%.

The anilox roller 32Y functions as an application roller for supplying the liquid developer to the developing roller 20Y and applying the liquid developer to the same. The anilox roller 32Y is a cylindrical roller having an undulated surface produced by uniformly forming fine helical grooves so as to make it easily bear a liquid developer. The liquid developer is supplied from the developer reservoir 31Y to the developing roller 20Y by means of the anilox roller 32Y. As shown in FIG. 2, when the apparatus is running, the supply roller 34Y rotates clockwise to supply the liquid developer to the anilox roller 32Y, and the anilox roller 32Y rotates counterclockwise to apply the liquid developer to the developing roller 20Y.

The restricting blade 33Y is an elastic blade having an elastic member arranged on the surface thereof. More specifically, the restricting blade 33Y includes a rubber section that is typically made of urethan rubber and is brought into abutting the surface of the anilox roller 32Y and a metal plate supporting the rubber section. The restricting blade 33Y restricts and adjusts the film thickness and the amount of the liquid developer conveyed by the anilox roller 32Y, and also adjusts the amount of the liquid developer to be supplied to the developing roller 20Y.

The developing roller 20Y is a cylindrical member that is driven to rotate counterclockwise around the axis of rotation thereof as shown in FIG. 2. The developing roller 20Y is formed by arranging an elastic layer typically made of polyurethane rubber, silicon rubber or NBR on the outer peripheral surface of an inner core, which is typically made of iron or some other metal. The developing roller cleaning blade 21Y is typically made of rubber and brought into abutting the surface of the developing roller 20Y. The developing roller cleaning blade 21Y is arranged at the downstream side relative to the development nip where the developing roller 20Y is brought into abutting the image carrier 10Y in the sense of rotation of the developing roller 20Y so as to scrape off and remove the liquid developer remaining on the developing roller 20Y.

The toner compression corona generator 22Y is an electric field application means for increasing a charged bias on the surface of the developing roller 20Y. The liquid developer conveyed by the developing roller 20Y is subjected to the application of an electric field by the toner compression corona generator 22Y at toner compression site in the direction from the toner compression corona generator 22Y toward the developing roller 20Y, as shown in FIG. 2.

As the electric field application means for toner compression, a compaction roller may be used in place of the corona discharger shown in FIG. 2 producing corona discharge. Such a compaction roller may be a cylindrical member and formed as an elastic roller by covering the surface thereof with an elastic material like the developing roller 20 Y. More specifically, the compaction roller may have a structure provided with a conductive resin layer or rubber layer is on an surface layer of a metal roller base material, and rotate in the clockwise direction opposite to the rotation direction of the developing roller 20Y.

The developer carried and toner-compressed by the developing roller 20Y is applied with an electric field at the development nip where the developing roller 20Y is brought into abutting the image carrier 10Y so as to be developed according to the latent image on the image carrier 10Y. The residual developer remaining on the development roller 20Y is scraped off and removed by the developing roller cleaning blade 21Y and dropped to the developing roller developer collection section 72Y so as to be reused. Note that the carrier liquid and the toner dropped to the developing roller developer collection section 72Y are not in a mixed color state.

An image carrier squeezing unit on the upstream side relative to the primary transfer is located on the downstream side relative to the developing device 20Y, opposed to the image carrier member 10Y, and collects the residual developer that is produced after the toner image on the image carrier 10Y is developed. The image carrier squeezing unit includes the image carrier squeezing roller 13Y constituted by an elastic roller member which has a surface covered with an elastic member and is brought into sliding contact with the image carrier 10Y so as to be driven to rotate and image carrier squeezing roller cleaning blade 14Y pressed against and brought into sliding contact with the image carrier squeezing roller 13Y to clean the surface thereof. The image carrier squeezing unit has a function of collecting the surplus carrier liquid and the unnecessary fogging toner from the developer of the image developed on the image carrier 10Y to raise the toner particle content ratio in the developed visible image.

In the primary transfer section 50Y, the developer image developed on the image carrier 10Y is transferred onto the intermediate transfer member 40 by the primary transfer roller 51Y. In this process, the image carrier 10Y and the intermediate transfer member 40 are configured to move at an equal speed, so that load caused by rotation and motion thereof is reduced and disturbance on the visualized toner image on the image carrier 10Y is suppressed.

A cleaning unit on the downstream side of the primary transfer is located on the downstream side relative to the primary transfer section 50Y, opposed to the image carrier member 10Y, and collects the residual liquid developer on the image carrier member 10Y before an electrostatic latent image is formed. The cleaning unit includes, as shown in FIG. 2, the image carrier cleaning roller 16Y constituted by an elastic roller member which has a surface covered with an elastic member and is brought into sliding contact with the image carrier 10Y so as to be driven to rotate and image carrier cleaning roller cleaning blade 17Y pressed against and brought into sliding contact with the image carrier squeezing roller 16Y to clean the surface thereof. The cleaning unit has a function of collecting the surplus carrier liquid and the unnecessary toner that has not been transferred. The image carrier cleaning roller 16Y has a structure in which a rubber layer is arranged on the surface of a metal roller base material and is applied with a bias voltage that attracts toner particles on the image carrier 11. The image carrier cleaning roller 16Y is provided mainly for the purpose of cleaning a toner particle component contained in the residual liquid developer.

The image carrier cleaning blade 18Y configured to perfectly clean the surface of the image carrier 10Y before a new electrostatic latent image is formed is arranged on the downstream side relative to the image carrier cleaning roller 16Y. The image carrier cleaning blade 18Y is provided mainly for the purpose of cleaning a carrier component contained in the residual liquid developer.

The intermediate transfer member squeezing unit 52K is arranged at the downstream side relative to the primary transfer section 50K to remove the surplus carrier liquid on the intermediate transfer member 40 and raise the toner particle content ratio in the developed visible image. In practicing the present invention, such a squeezing unit may be arranged at an arbitrary location upstream relative to a detection section of an optical sensor 90.

Like the image carrier squeezing units, the intermediate transfer member squeezing unit 52K includes an intermediate transfer member squeezing roller 53K which is an elastic roller member having an elastic member arranged on the surface thereof and brought into sliding contact with the intermediate transfer member 40 so as to be driven to rotate, a backup roller 54K arranged opposite to the intermediate transfer member squeezing roller 53K with the intermediate transfer member 40 interposed between them, a cleaning blade 55K pressed against and brought into sliding contact with intermediate transfer member squeezing roller 53K to collect the surplus carrier and unnecessary fogging toner from the developer primary-transferred onto the intermediate transfer member 40.

Next, the flow of the liquid developer in the image forming apparatus according to the present invention will be described with reference to FIGS. 1 and 2. The secondary transfer roller 61 is arranged opposite to the belt drive roller 41 with the intermediate transfer member 40 interposed between them. Further, the cleaning unit including the secondary transfer roller cleaning blade 62 is also arranged for the secondary transfer roller 61.

Reference numeral 63 is a secondary transfer roller developer collection section for receiving the liquid developer dropped from the secondary roller cleaning blade 62. A pipe for evacuating the liquid developer received from the blade is connected to the lower part of the secondary transfer roller developer collection section 63. This pipe communicates with a first waste tank 440. The liquid developer scraped off by the secondary transfer roller cleaning blade 62 is a liquid developer in which toners of different colors are mixed, so that the liquid developer collected in the secondary transfer roller developer collection section 63 is discharged to the first waste tank 440 through the pipe.

Reference numeral 47 is a secondary intermediate transfer member developer collection section for receiving the liquid developer dropped from the intermediate transfer member cleaning blade 46. A pipe for evacuating the liquid developer received from the blade is connected to the lower part of the secondary intermediate transfer member developer collection section 47. This pipe communicates with a second waste tank 441. The liquid developer scraped off by the intermediate transfer member cleaning blade 46 is a liquid developer in which toners of different colors are mixed, so that the liquid developer collected in the secondary intermediate transfer member developer collection section 47 is discharged to the second waste tank 440 through the pipe.

In FIG. 1, reference numerals 400Y, 400M, 400C, and 400K denote agitation tanks, 401Y, 401M, 401C, and 401K denote developer supply tanks, 402Y, 402M, 402C, and 402K denote buffer tanks, 410 denotes a carrier tank, 450Y, 450M, 450C, and 450K denote first pumps, 451Y, 451M, 451C, and 451K denote second pumps, 452Y, 452M, 452C, and 452K denote third pumps, and 453Y, 453M, 453C, and 453K denote fourth pumps. The lines connecting among the reservoirs, collection sections, tanks, and pumps schematically denote the pipes.

The agitation tanks 400Y, 400M, 400C, and 400K are tanks for preparing a liquid developer having a toner solid concentration of about 20% to be supplied to the developer reservoirs 31Y, 31M, 31C, and 31K.

The developer supply tanks 401Y, 401M, 401C, and 401K are tanks for storing a high concentration toner having a toner solid concentration of 20% or more. The carrier tank 410, which is a tank for storing a carrier stock solution, is piped to the agitation tanks 400Y, 400M, 400C, and 400K of respective colors through the fourth pumps 453Y, 453M, 453C, and 453K.

The agitation tanks 400Y, 400M, 400C, and 400K receive supply of high concentration toners from the developer supply tanks 401Y, 401M, 401C, and 401K. To this end, the second pumps 451Y, 451M, 451C, and 451K are driven.

The agitation tanks 400Y, 400M, 400C, and 400K also receive supply of a carrier stock solution from the carrier tank 410 by means of the drive of the fourth pumps 453Y, 453M, 453C, and 453K.

The agitation tanks 400Y, 400M, 400C, and 400K are each provided with toner concentration detection means (not shown) such as an optical sensor. The agitation tanks 400Y, 400M, 400C, and 400K use the toner concentration detection means to detect the concentration and perform on/off control of the respective pumps using a not shown controller so as to maintain appropriate concentration of the liquid developer in the agitation tanks 400Y, 400M, 400C, and 400K. Further, the agitation tanks 400Y, 400M, 400C, and 400K are each provided with not shown agitation units and uniformly agitate the developer therein by driving the agitation units.

During the operating time of the apparatus, adequate amount of liquid developer is always supplied from the agitation tanks 400Y, 400M, 400C, and 400K to the developer reservoirs 31Y, 31M, 31C, and 31K by means of the first pumps 450Y, 450M, 450C, and 450K.

The liquid developer collected in the first image carrier developer collection sections 70Y, 70M, 70C, and 70K and developing roller developer collection section 72Y, 72M, 72C, and 72K is introduced into the agitation tanks 400Y, 400M, 400C, and 400K through the pipes so as to be reused.

The liquid developer collected in the third image carrier developer collection sections 73Y, 73M, 73C, and 73K is introduced into the buffer tanks 402Y, 402M, 402C, and 402K through the pipes for temporary storage. The liquid developer in the buffer tanks 402Y, 402M, 402C, and 402K is fed to the agitation tanks 400Y, 400M, 400C, and 400K by the operation of the second pumps 451Y, 451M, 451C, and 451K. The reason that the second pumps 451Y, 451M, 451C, and 451K are used here is that the solid concentration of the liquid developer collected in the third image carrier developer collection sections 73Y, 73M, 73C, and 73K is high.

The liquid developer collected in the developer collection sections of respective color units has not been subjected to color superposition and therefore are not in a mixed color state, so that it is to be reused. On the other hand, the liquid developer collected in the first intermediate transfer member developer collection section 84K is a liquid developer in which toners of different colors are mixed, so that the liquid developer collected in the first intermediate transfer member developer collection section 84K is discharged to the second waste tank 441 through the pipe.

Next, a determination means for realizing a plurality of modes in which images are formed in different types of recording media will be described. The image forming apparatus according to the present invention has a plurality of image forming modes by which images can be printed on different types of papers (art paper, coated paper, high-quality paper, regular paper, etc.).

The reason that the plurality of image forming modes corresponding to the paper types are required is that the amount of the carrier required in an image forming process differs depending on the paper type. The image forming apparatus according to the present invention has two image forming modes for a first type recording medium, typified by art paper, coated paper, etc., having a comparatively smooth surface on which there is little unevenness as viewed microscopically and a second type recording medium, typified by high-quality paper, regular paper, etc., having a comparatively rough surface on which there is much unevenness as viewed microscopically.

In order to achieve a transfer process including primary and secondary transfer using a liquid developer, a sufficient amount of a carrier is required to electrophorese the toner. Therefore, the amount of a carrier required for the first type recording medium having a surface on which there is little unevenness is small, and amount of a carrier required for the second type recording medium having a surface on which there is much unevenness is larger than the case of the first type recording medium.

In the present embodiment, a paper type determination sensor 5 as shown in FIG. 1 is provided for detecting the type of a recording medium. The paper type determination sensor 5 is constituted by a light-emitting element 6 that irradiates a recording medium conveyed along the conveyance route with a light and a light receiving element 7 that detects reflection of the reflected light from the recording medium. In the present embodiment, a signal such as reflectance of the reflected light is input from the light-receiving element 7 to a not shown controller such as a CPU, where the type (art paper, coated paper, high-quality paper, regular paper, etc.) of the recording medium is determined.

Next, a color shift compensation mode in the present invention will be described. There exists a problem of color shift in the image forming apparatus according to the present invention that performs image formation using developing units 30Y, 30M, 30C, and 30K of four colors. That is, when toner images respectively formed by the different developing units 30Y, 30M, 30C, and 30K are transferred onto the intermediate transfer member 40, the transfer positions are shifted from one another, which appears as a change in the color tone on a recording medium.

To eliminate this problem, the image formation apparatus has a color shift compensation mode. In this color shift compensation mode, reference pattern images (hereinafter, referred to as "resist marks") for detecting color shift, which are previously formed on the intermediate transfer member 40, are detected using the optical sensor 90 to acquire position information of the resist marks, and positioning (color shift compensation processing, displacement compensation processing) of respective toner images are performed based on the acquired position information.

The optical sensor 90 for detecting the resist marks are provided at the preceding stage of the transfer nip of the secondary transfer unit 60 as shown in FIG. 1. As the optical sensor 90, a known device such as a light-emitting and light-receiving element pair or CCD camera can be used.

Figure 11:
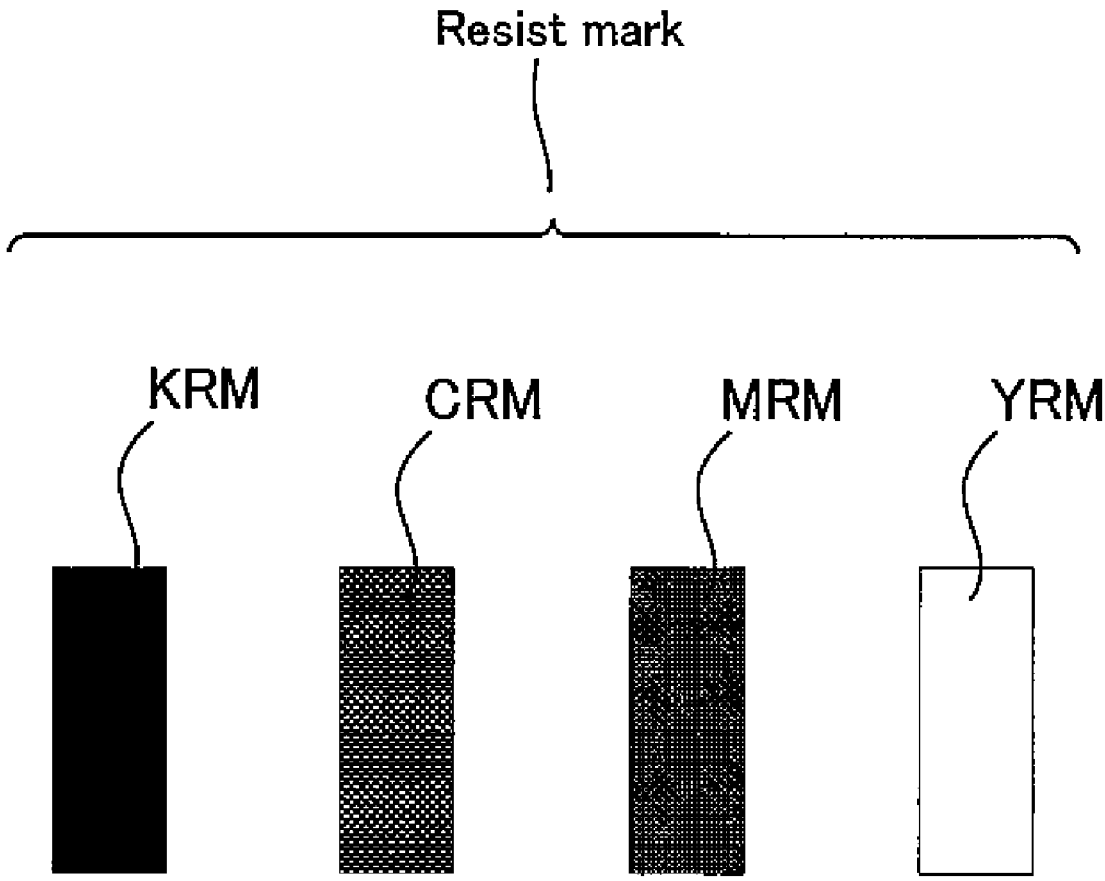
FIG. 11 is a view showing an example of resist marks formed onto an intermediate transfer member 40.

As shown in FIG. 11, in this color shift compensation mode, resist marks YRM (yellow resist mark), MRM (magenta resist mark), CRM (cyan resist mark), and KRM (black resist mark) are formed, as toner images, in this order onto the intermediate transfer member 40 through the image forming process executed immediately after power-on.

The resist marks thus formed are detected by the optical sensor 90, and color shift amount between different colors is calculated by a not shown calculation means. In the color shift compensation mode, the image forming apparatus is controlled such that the color shift amount calculated by the calculation means is compensated by a known means.

A toner image containing the carrier liquid on the intermediate transfer member 40 has high specularity, which may cause the resist marks to erroneously be detected by the optical sensor 90. That is, at the color shift compensation processing time in a wet-developing image forming apparatus, resist mark detection results obtained by the optical sensor 90 may degrade in accuracy, with the result that accurate position information of the resist marks cannot be obtained, thus preventing accurate color shift compensation.

In order to cope with this problem, a method can be considered in which the carrier liquid on the intermediate transfer member 40 is removed at the color shift compensation processing time. However, when the carrier liquid on the intermediate transfer member 40 is removed, solid content ratio in the resist marks is increased. When the resist marks on the intermediate transfer member 40 proceed in the process downstream and pass through the secondary transfer unit 60, the solid content ratio in the resist marks are further increased. Then, there arises a new problem that cleaning performance when cleaning the resist marks transferred onto the intermediate transfer member 40 by means of the intermediate transfer member cleaning blade 46 is deteriorated.

In view of this, at execution time of the color shift compensation mode in the present invention, the carrier contained in the resist marks is removed while the removal amount thereof is controlled so as not to be excessive. More specifically, the color shift compensation mode in the present invention is executed under a condition of the same carrier removal amount as in the image forming mode in which the removal amount of the carrier on the intermediate transfer member 40 is largest of all the image forming modes provided in the image forming apparatus.

Thus, as described above, when the carrier on the intermediate transfer member 40 is removed in order to prevent deterioration in the accuracy of the resist mark detection results obtained by the optical sensor 90 in the color shift compensation mode, the color shift compensation mode is executed under the same condition as in the image forming mode in terms of the carrier removal amount. This prevents deterioration in the cleaning performance when cleaning the resist marks transferred onto the intermediate transfer member 40 by means of the intermediate transfer member cleaning blade. That is, according to the present invention, there can be provided an image forming apparatus capable of achieving both the prevention of deterioration in the resist mark detection accuracy and prevention of deterioration in the cleaning performance with respect to the intermediate transfer member in a balanced manner.

An example of a plurality of image forming modes provided in an image forming apparatus includes those by which images can be formed on different types of papers. The image forming apparatus according to the present invention has two image forming modes: a mode (first type recording medium image forming mode) for image forming on a first type recording medium (art paper and coated paper) having a surface on which there is comparatively little unevenness and a mode (second type recording medium image forming mode) for image forming on a second type recording medium (high-quality paper and regular paper) having a surface on which there is comparatively much unevenness. The amount of a carrier required in the first type recording medium image forming mode is controlled to be small, and amount of a carrier required in the second type recording medium image forming mode is controlled to be larger than the first type recording medium image forming mode. In the first embodiment, the color shift compensation mode is executed under a condition (first condition) of the same carrier removal amount as in the first type recording medium image forming mode.

When the second type recording medium image forming mode is executed, the intermediate transfer member squeezing roller 53K of the intermediate transfer member squeezing unit is controlled to be rotated at the same peripheral rotation speed as the moving speed of the intermediate transfer member 40. On the other hand, in the first type recording medium forming mode, the intermediate transfer member squeezing roller 53K is controlled to be rotated at a peripheral rotation speed higher than the moving speed of the intermediate transfer member 40 to increase the amount of the carrier on the intermediate transfer member 40 to be removed by the intermediate transfer member squeezing roller 53K as compared to the removal amount in the second type recording medium image forming mode so as to achieve an optimum condition for image forming on a recording medium such as art paper or coated paper. In the present embodiment, the same carrier removal condition (this carrier removal condition is referred to as "first condition") as in this first type recording medium image forming mode is applied to the color shift compensation mode (note that the carrier removal condition in the second type recording medium image forming mode is referred to as "second condition").

An example of conditions at the execution time of the first and second type recording medium image forming modes in the first embodiment of the present invention is shown in the following Table 1.

TABLE 1

| | First type recording medium | | Second type recording medium | |
|---|---|---|---|---|
| | Art paper | Coated paper | High-quality paper | Regular paper |
| Peripheral speed of intermediate transfer member squeezing roller [mm/s] | 210 | | 200 | |
| Solid content ratio on intermediate transfer member observed at position of optical sensor 90 [%] | 40 | | 35 | |

Another example of the operation of the intermediate transfer member squeezing unit will be described below. FIG. 3A shows a state of the intermediate transfer member squeezing unit at the execution time of the second type recording medium image forming mode, and FIG. 3B shows a state of the intermediate transfer member squeezing unit at the execution time of the first type recording medium image forming mode. As shown in FIGS. 3A and 3B, a configuration may be adopted in which, in the second type recording medium image forming mode, the intermediate transfer member squeezing roller 53K is controlled to be rotated in the same direction as the moving direction of the intermediate transfer member 40 at the nip portion, while in the first type recording medium image forming mode, the intermediate transfer member squeezing roller 53K is controlled to be rotated in the reverse direction to the moving direction of the intermediate transfer member 40 at the nip portion so as to increase the amount of the carrier on the intermediate transfer member 40 to be removed by the intermediate transfer member squeezing roller 53K as compared to the removal amount in the second type recording medium image forming mode. In the present embodiment, the same carrier removal condition as in such a first type recording medium image forming mode may be applied to the color shift compensation mode.

The conditions for the operation of the squeezing unit and other components at the execution time of the first type recording medium image forming mode, second type recording medium image forming mode, and color shift compensation mode are stored in a not shown storage means, and when each of the above modes is executed, a corresponding condition stored in the storage means is applied. Such a configuration is applied to all embodiments of the present invention.

Further, in the first type recording medium image forming mode, the intermediate transfer member squeezing roller 53K may be controlled to be rotated at a peripheral rotation speed higher than the moving speed of the intermediate transfer member 40 in the reverse direction to the moving direction of the intermediate transfer member 40 at the nip portion. The same carrier removal condition as in such a first type recording medium image forming mode may be applied to the color shift compensation mode.

In the example shown in FIG. 3B, the intermediate transfer member squeezing roller 53K is rotated in the reverse direction to the moving direction of the intermediate transfer member 40, so that the resist marks formed on the intermediate transfer member 40 may be disturbed. Thus, in the color shift compensation mode, a bias voltage for pressing the toner in the resist marks from the intermediate transfer member squeezing roller 53K to the intermediate transfer member 40 is preferably applied.

As described above, according to the first embodiment of the present invention, since the color shift compensation mode is executed under the same condition as in the first type recording medium image forming mode in which the removal amount of the carrier on the intermediate transfer member 40 is increased as compared to the removal amount in the second type recording medium image forming mode, the position information of the resist marks can be accurately acquired without deterioration in the accuracy of the resist mark detection results obtained by the optical sensor, thereby achieving accurate color shift compensation. Further, since the color shift compensation mode is executed under the same condition as in the image forming mode provided in the image forming apparatus in terms of the removal amount of the carrier on the intermediate transfer member 40, it is possible to prevent deterioration in the cleaning performance of the cleaning blade for cleaning the resist marks transferred onto the intermediate transfer medium 40. That is, according to the present invention, there can be provided an image forming apparatus capable of achieving both the prevention of deterioration in the resist mark detection accuracy and prevention of deterioration in the cleaning performance with respect to the intermediate transfer member in a balanced manner.

Figure 4:
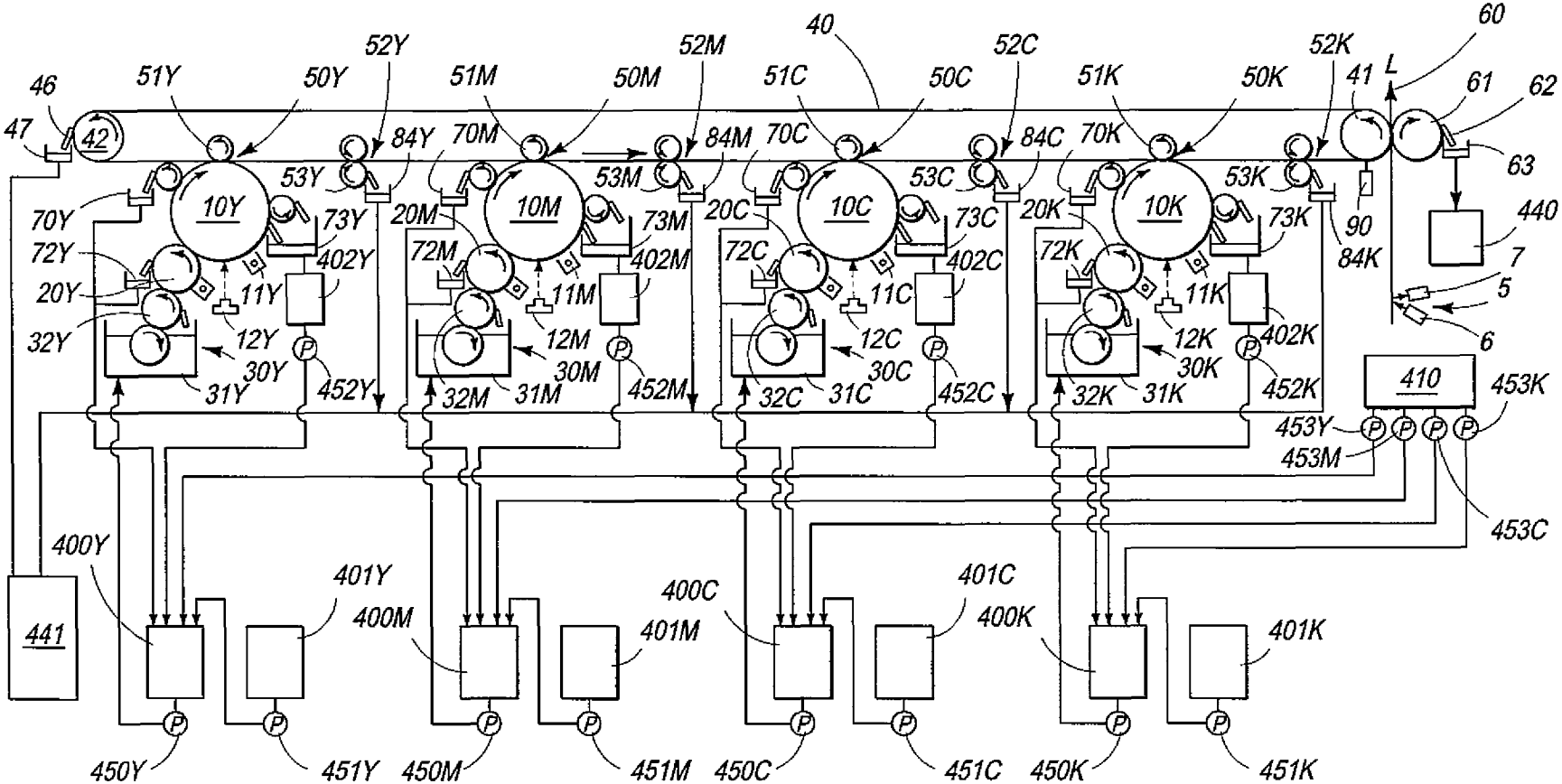
FIG. 4 is a view showing main components constituting an image forming apparatus according to a second embodiment of the present invention.

Next, a second embodiment of the present invention will be described. FIG. 4 is a view showing main components constituting an image forming apparatus according to the second embodiment of the present invention, and FIG. 5 is a cross-sectional view showing main components of an image forming section and developing unit in the second embodiment of the present invention.

In the first embodiment, the intermediate transfer member squeezing unit is provided only at the portion immediately downstream relative to the transfer nip of the image carrier 10K, while in the second embodiment, four intermediate transfer member squeezing units are provided at the portions immediately downstream relative to respective transfer nips of the image carriers 10Y, 10M, 10C, and 10K.

Figure 5:
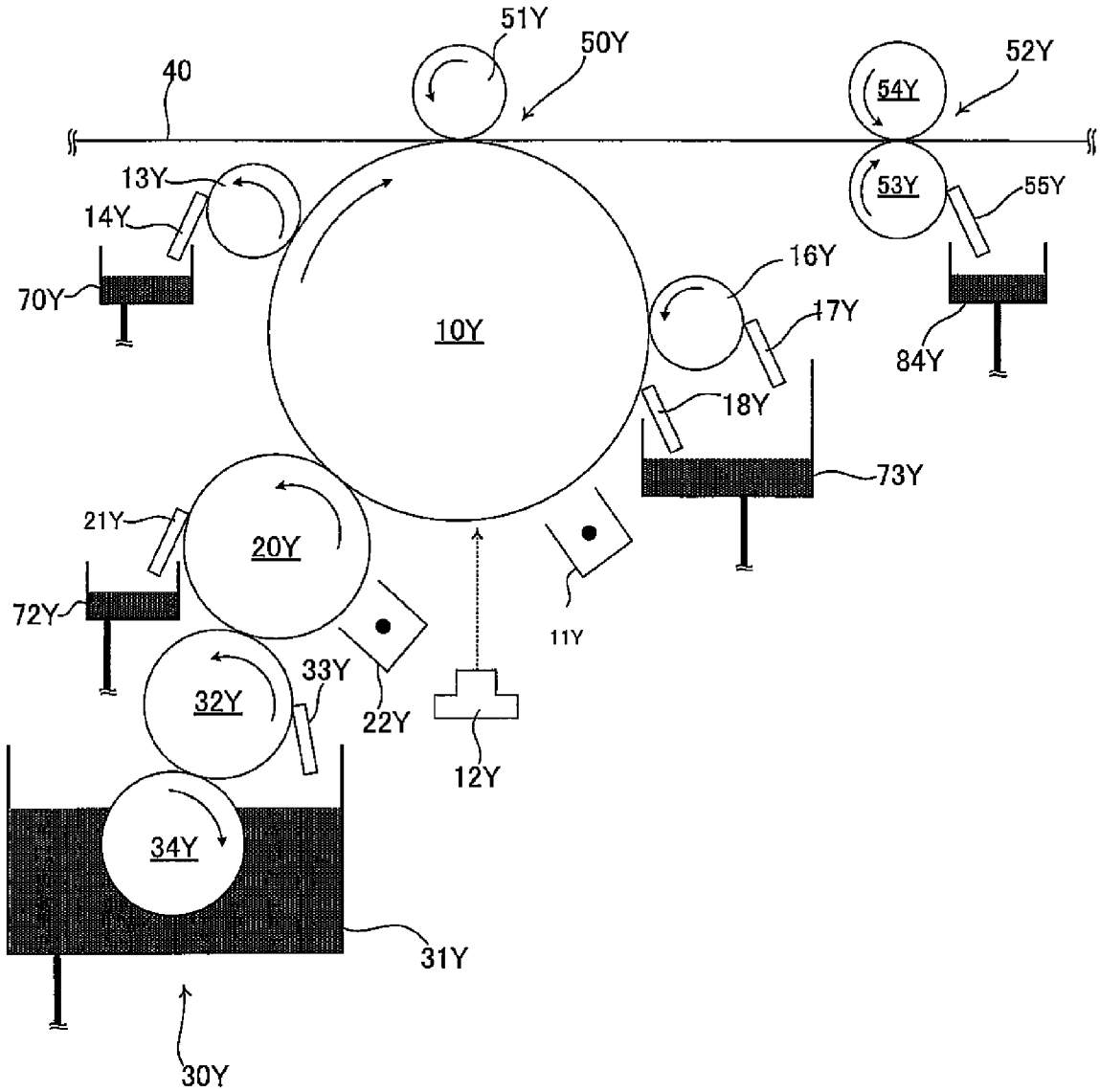
FIG. 5 is a cross-sectional view showing main components of an image forming section and developing unit in the second embodiment of the present invention.

With reference to FIG. 5, the intermediate transfer member squeezing units will be described by taking the intermediate transfer member squeezing unit provided at the portion immediately downstream relative to the transfer nip of the image carrier 10Y as an example. Since the intermediate transfer member squeezing units provided for the developing units of other colors have the same configuration, only the intermediate transfer member squeezing unit provided for the developing unit of yellow will be described below.

The intermediate transfer member squeezing unit (in this case, for developing unit of yellow color) according to the second embodiment squeezes the intermediate transfer member 40 at the portion immediately downstream relative to the transfer nip of the image carrier 10Y. In the present embodiment, an intermediate transfer member squeezing unit 52Y constituted by an intermediate transfer member squeezing roller 53Y, a backup roller 54Y, an intermediate transfer member squeezing roller cleaning blade 55Y is arranged on the downstream side relative to the developing unit 30Y in the moving direction of the intermediate transfer member 40.

Reference numeral 84Y is a first intermediate transfer member developer collection section for receiving a liquid developer dropped from the intermediate transfer member squeezing roller cleaning blade 55Y. A pipe for evacuating the liquid developer received from the blade is connected to the lower part of the first intermediate transfer member developer collection section 84Y. The liquid developer collected in the first intermediate transfer member developer collection section 84Y is a liquid developer in which toners of different colors are mixed, so that the liquid developer collected in first intermediate transfer member developer collection section 84Y is discharged to the second waste tank 441 through the pipe and is not reused.

In the second embodiment, the intermediate transfer member squeezing units 52Y, 52M, 52C, and 52K are used to switch the carrier removal condition between the first and second type recording medium image forming modes.

Also in the second embodiment, the color shift compensation mode is executed under the condition in which the removal amount of the carrier on the intermediate transfer member 40 is increased as compared to the removal amount in the second type recording medium image forming mode. As the concrete condition in this case, the same condition set in the first type recording medium image forming mode is adopted.

In the image forming apparatus according to the second embodiment of the present invention, when executing the color shift compensation mode, the intermediate transfer member squeezing units 52Y, 52M, 52C, and 52K provided immediately downstream relative to the primary transfer nips of the image carriers of respective colors are used to remove a larger amount of carrier than in the second type recording medium image forming mode. In the present embodiment, the same carrier removal condition as in this first type recording medium forming mode is applied to the color shift compensation mode.

When the second type recording medium image forming mode is executed, the intermediate transfer member squeezing rollers 53Y, 53M, 53C, and 53K of the intermediate transfer member squeezing units 52Y, 52M, 52C, and 52K are controlled to be rotated at the same peripheral rotation speed as the moving speed of the intermediate transfer member 40. On the other hand, in the first type recording medium forming mode, the intermediate transfer member squeezing rollers 53Y, 53M, 53C, and 53K are controlled to be rotated at a peripheral rotation speed higher than the moving speed of the intermediate transfer member 40 to increase the amount of the carrier on the intermediate transfer member 40 to be removed by the intermediate transfer member squeezing rollers 53Y, 53M, 53C, and 53K as compared to the removal amount in the second type recording medium image forming mode. The same carrier removal condition as in this first type recording medium image forming mode is applied to the color shift compensation mode.

An example of conditions at the execution time of the first and second type recording medium image forming modes in the second embodiment is shown in the following Table 2.

TABLE 2

| | First type recording medium | | Second type recording medium | |
|---|---|---|---|---|
| | Art paper | Coated paper | High-quality paper | Regular paper |
| Peripheral speed of intermediate transfer member squeezing roller [mm/s] | 205 | | 200 | |
| Solid content ratio on intermediate transfer member observed at position of optical sensor 90 [%] | 40 | | 35 | |

Although not shown, a configuration may be adopted in which, in the second type recording medium image forming mode, the intermediate transfer member squeezing rollers 53Y, 53M, 53C, and 53K are controlled to be rotated in the same direction as the moving direction of the intermediate transfer member 40 at the respective nip portions, while in the first type recording medium image forming mode, the intermediate transfer member squeezing rollers 53Y, 53M, 53C, and 53K are controlled to be rotated in the reverse direction to the moving direction of the intermediate transfer member 40 at the respective nip portions so as to increase the amount of the carrier on the intermediate transfer member 40 to be removed by the intermediate transfer member squeezing rollers 53Y, 53M, 53C, and 53K as compared to the removal amount in the second type recording medium image forming mode. The same carrier removal condition as in such a first type recording medium image forming mode may be applied to the color shift compensation mode.

Further, in the first type recording medium image forming mode, the intermediate transfer member squeezing rollers 53Y, 53M, 53C, and 53K may be controlled to be rotated at a peripheral rotation speed higher than the moving speed of the intermediate transfer member 40 in the reverse direction to the moving direction of the intermediate transfer member 40 at the respective nip portions. The same carrier removal condition as in such a first type recording medium image forming mode may be applied to the color shift compensation mode.

In the above cases, the intermediate transfer member squeezing rollers 53Y, 53M, 53C, and 53K are rotated in the reverse direction to the moving direction of the intermediate transfer member 40, so that the resist marks formed on the intermediate transfer member 40 may be disturbed. Thus, in the color shift compensation mode, a bias voltage for pressing the toner in the resist marks from the intermediate transfer member squeezing rollers 53Y, 53M, 53C, and 53K to the intermediate transfer member 40 is preferably applied.

As described above, according to the second embodiment of the present invention, since the color shift compensation mode is executed under the same condition as in the first type recording medium image forming mode in which the removal amount of the carrier on the intermediate transfer member 40 is increased as compared to the removal amount in the second type recording medium image forming mode, the position information of the resist marks can be accurately acquired without deterioration in the accuracy of the resist mark detection results obtained by the optical sensor, thereby achieving accurate color shift compensation. Further, since the color shift compensation mode is executed under the same condition as in the image forming mode provided in the image forming apparatus in terms of the removal amount of the carrier on the intermediate transfer member 40, it is possible to prevent deterioration in the cleaning performance of the cleaning blade for cleaning the resist marks transferred onto the intermediate transfer medium 40.

Next, a third embodiment of the present invention will be described. The third embodiment can be practiced by the same configuration as those of the first and second embodiments. Also in the third embodiment, at the execution time of the first type recording medium image forming mode, the removal amount of the carrier on the intermediate transfer member 40 is increased as compared to the removal amount in the second type recording medium image forming mode. To this end, in the third embodiment, when executing the first type recording medium image forming mode, the image carrier squeezing rollers 13Y, 13M, 13C, and 13K provided immediately upstream relative to the primary transfer nips of the image carriers of respective colors are used to remove a larger amount of carrier than in the second type recording medium image forming mode and thus to increase the removal amount of the carrier on the intermediate transfer member 40. The same carrier removal condition as in this first type recording medium forming mode may be applied to the color shift compensation mode.

An example of conditions at the execution time of the first and second type recording medium image forming modes set for practicing the third embodiment using the configuration of FIG. 1 is shown in the following Table 3.

TABLE 3

| | First type recording medium | | Second type recording medium | |
|---|---|---|---|---|
| | Art paper | Coated paper | High-quality paper | Regular paper |
| Peripheral speed of image carrier squeezing roller [mm/s] | 205 | | 200 | |
| Solid content ratio on intermediate transfer member observed at position of optical sensor 90 [%] | 40 | | 35 | |

An example of conditions at the execution time of the first and second type recording medium image forming modes set for practicing the third embodiment using the configuration of FIG. 4 is shown in the following Table 4.

TABLE 4

| | First type recording medium | | Second type recording medium | |
|---|---|---|---|---|
| | Art paper | Coated paper | High-quality paper | Regular paper |
| Peripheral speed of image carrier squeezing roller [mm/s] | 202 | | 200 | |
| Solid content ratio on intermediate transfer member observed at position of optical sensor 90 [%] | 40 | | 35 | |

In the second type recording medium image forming mode, the image carrier squeezing rollers 13Y, 13M, 13C, and 13K are controlled to be rotated at the same peripheral rotation speed as that of the image carriers 10Y 10M, 10C, and 10K. On the other hand, in the first type recording medium image forming mode, the image carrier squeezing rollers 13Y, 13M, 13C, and 13K are controlled to be rotated at a peripheral rotation speed higher than that of the image carriers 10Y, 10M, 10C, and 10K so as to increase the removal amount of the carrier on the image carriers 10Y, 10M, 10C, and 10K and thus to increase the removal amount of the carrier on the intermediate transfer member 40 as compared to the removal amount in the second type recording medium image forming mode. The same carrier removal condition as in this first type recording medium image forming mode may be applied to the color shift compensation mode.

Although not shown, a configuration may be adopted in which, in the second type recording medium image forming mode, the image carrier squeezing rollers 13Y, 13M, 13C, and 13K are controlled to be rotated in the same direction as the rotation direction of the image carriers 10Y, 10M, 10C, and 10K at the respective nip portions, while in the first type recording medium image forming mode, the image carrier squeezing rollers 13Y, 13M, 13C, and 13K are controlled to be rotated in the reverse direction to the rotation direction of the image carriers 10Y, 10M, 10C, and 10K at the respective nip portions so as to increase the removal amount of the carrier on the image carriers 10Y, 10M, 10C, and 10K and thus to increase the removal amount of the carrier on the intermediate transfer member 40 as compared to the removal amount in the second type recording medium image forming mode. The same carrier removal condition as in this first type recording medium image forming mode may be applied to the color shift compensation mode.

Further, in the first type recording medium image forming mode, the image carrier squeezing rollers 13Y, 13M, 13C, and 13K may be controlled to be rotated at a peripheral rotation speed higher than the rotation speed of the image carriers 10Y, 10M, 10C, and 10K in the reverse direction to the rotation direction of the image carriers 10Y, 10M, 10C, and 10K at the respective nip portions. The same carrier removal condition as in such a first type recording medium image forming mode may be applied to the color shift compensation mode.

As described above, according to the third embodiment of the present invention, since the color shift compensation mode is executed under the same condition as in the first type recording medium image forming mode in which the removal amount of the carrier on the intermediate transfer member 40 is increased as compared to the removal amount in the second type recording medium image forming mode, the position information of the resist marks can be accurately acquired without deterioration in the accuracy of the resist mark detection results obtained by the optical sensor, thereby achieving accurate color shift compensation. Further, in the present embodiment, the carrier collected by the image carrier squeezing rollers 13Y, 13M, 13C, and 13K can be reused, achieving effective use of the liquid developer. Further, since the color shift compensation mode is executed under the same condition as in the image forming mode provided in the image forming apparatus in terms of the removal amount of the carrier on the intermediate transfer member 40, it is possible to prevent deterioration in the cleaning performance of the cleaning blade for cleaning the resist marks transferred onto the intermediate transfer medium 40. That is, according to the present invention, there can be provided an image forming apparatus capable of achieving both the prevention of deterioration in the resist mark detection accuracy and prevention of deterioration in the cleaning performance with respect to the intermediate transfer member in a balanced manner.

Figure 6:
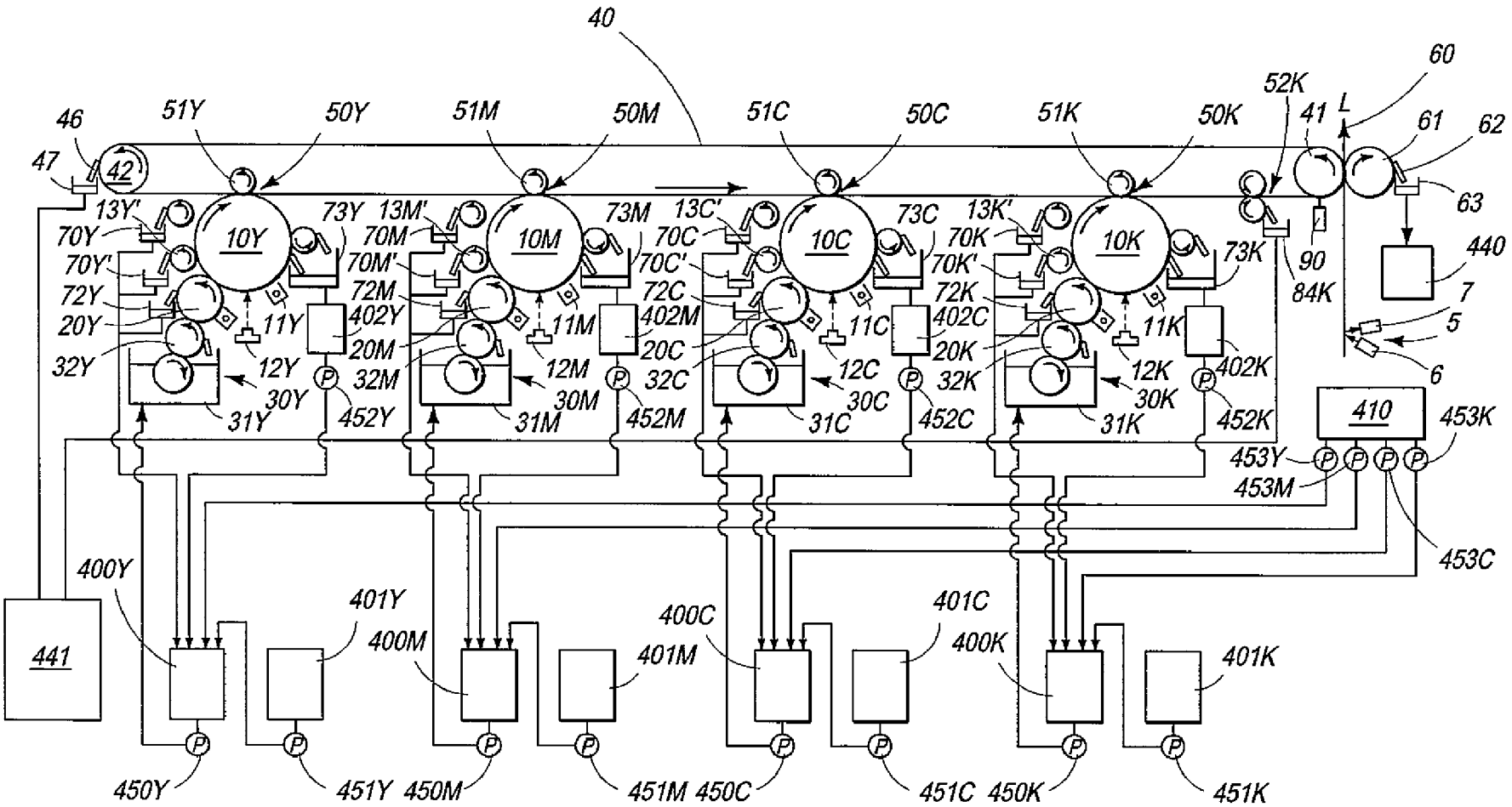
FIG. 6 is a view showing main components constituting an image forming apparatus according to a fourth embodiment of the present invention.
Figure 7:
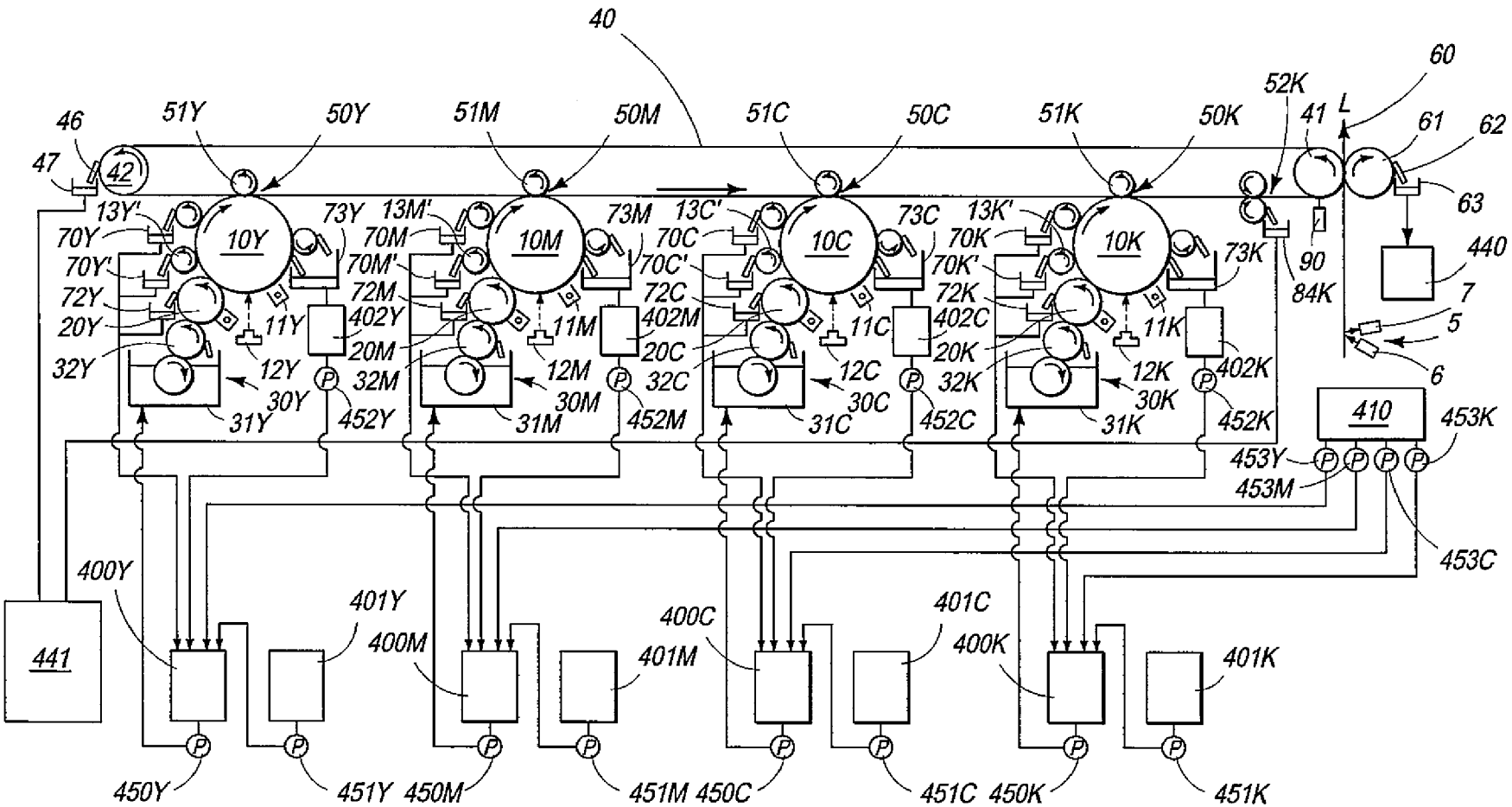
FIG. 7 is another view showing main components constituting an image forming apparatus according to the fourth embodiment of the present invention.
Figure 8:
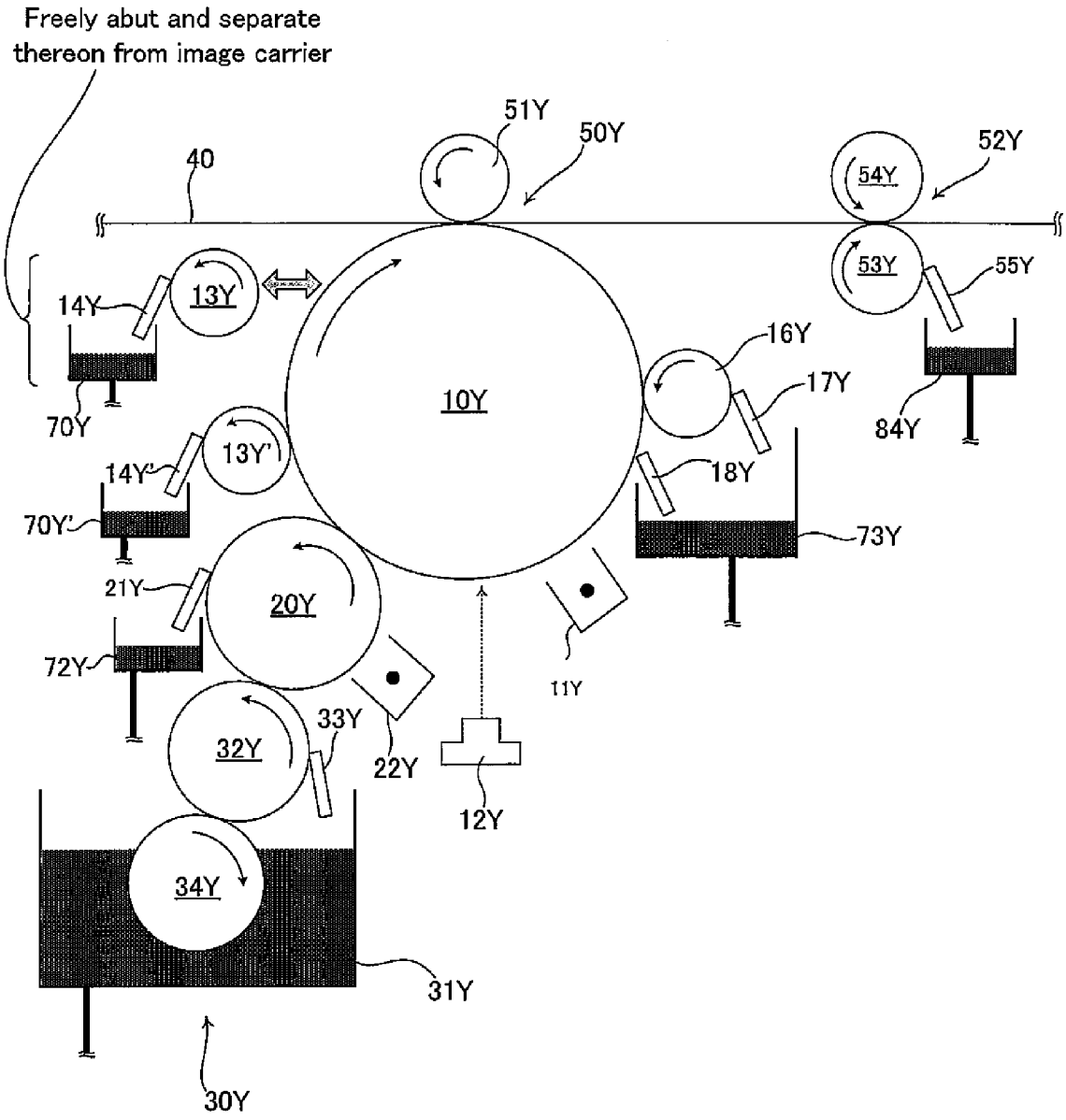
FIG. 8 is a cross-sectional view showing main components of an image forming section and developing unit in the fourth embodiment of the present invention.

Next, a fourth embodiment of the present invention will be described. FIGS. 6 and 7 are views showing main components constituting an image forming apparatus according to the fourth embodiment of the present invention, and FIG. 8 is a cross-sectional view showing main components of an image forming section and developing unit in the fourth embodiment of the present invention.

In the third embodiment, each squeezing unit corresponding to each of the image carriers 10Y, 10M, 10C, and 10K has one image carrier squeezing roller, while in the present embodiment, each squeezing unit has two image carrier squeezing rollers. That is, in the image forming apparatus according to the present embodiment, image carrier squeezing rollers 13Y', 13M', 13C', and 13K' are provided in addition to the image carrier squeezing rollers 13Y, 13M, 13C, and 13K. Further, in the present embodiment, the image carrier squeezing rollers 13Y, 13M, 13C, and 13K are arranged so as to freely abut and separate thereon from the image carriers 10Y, 10M, 10C, and 10K.

Also in the fourth embodiment, at the execution time of the first type recording medium image forming mode, the removal amount of the carrier on the intermediate transfer member 40 is increased as compared to the removal amount in the second type recording medium image forming mode. To this end, in the fourth embodiment, when executing the first type recording medium image forming mode, the image carrier squeezing rollers 13Y, 13M, 13C, and 13K that have been separated from the image carriers 10Y, 10M, 10C, and 10K in a normal state are brought into abutting the image carriers 10Y, 10M, 10C, and 10K to remove a larger amount of carrier on the image carriers 10Y, 10M, 10C, and 10K than in the second type recording medium image forming mode and thus to increase the removal amount of the carrier on the intermediate transfer member 40. The same carrier removal condition as in this first type recording medium forming mode may be applied to the color shift compensation mode. An example of conditions at the execution time of the first and second type recording medium image forming modes in the fourth embodiment is shown in the following Table 5.

TABLE 5

| | First type recording medium | | Second type recording medium | |
|---|---|---|---|---|
| | Art paper | Coated paper | High-quality paper | Regular paper |
| Number of squeezing rollers abutting image carriers | 2 | | 1 | |
| Peripheral speed of image carrier squeezing roller [mm/s] | 200 | | 200 | |
| Solid content ratio on intermediate transfer member observed at position of optical sensor 90 [%] | 40 | | 35 | |

Further, in the first type recording medium image forming mode, the image carrier squeezing rollers 13Y, 13M, 13C, and 13K brought into abutting the image carriers may be controlled to be rotated at a peripheral rotation speed higher than that of the image carriers 10Y, 10M, 10C, and 10K so as to increase the removal amount of the carrier on the image carriers 10Y, 10M, 10C, and 10K and thus to increase the removal amount of the carrier on the intermediate transfer member 40 as compared to the removal amount in the second type recording medium image forming mode. The same carrier removal condition as in this first type recording medium image forming mode may be applied to the color shift compensation mode.

Further, in the first type recording medium image forming mode, the image carrier squeezing rollers 13Y, 13M, 13C, and 13K brought into abutting the image carriers may be controlled to be rotated in the reverse direction to the rotation direction of the image carriers 10Y, 10M, 10C, and 10K at the respective nip portions so as to increase the removal amount of the carrier on the image carriers 10Y, 10M, 10C, and 10K and thus to increase the removal amount of the carrier on the intermediate transfer member 40 as compared to the removal amount in the second type recording medium image forming mode. The same carrier removal condition as in this first type recording medium image forming mode may be applied to the color shift compensation mode.

Further, in the first type recording medium image forming mode, the image carrier squeezing rollers 13Y, 13M, 13C, and 13K brought into abutting the image carriers may be controlled to be rotated at a peripheral rotation speed higher than the rotation speed of the image carriers 10Y, 10M, 10C, and 10K in the reverse direction to the rotation direction of the image carriers 10Y, 10M, 10C, and 10K at the respective nip portions. The same carrier removal condition as in such a first type recording medium image forming mode may be applied to the color shift compensation mode.

As described above, according to the fourth embodiment of the present invention, since the color shift compensation mode is executed under the same condition as in the first type recording medium image forming mode in which the removal amount of the carrier on the intermediate transfer member 40 is increased as compared to the removal amount in the second type recording medium image forming mode, the position information of the resist marks can be accurately acquired without deterioration in the accuracy of the resist mark detection results obtained by the optical sensor, thereby achieving accurate color shift compensation. Further, in the present embodiment, the carrier collected by the image carrier squeezing rollers 13Y, 13M, 13C, and 13K can be reused, achieving effective use of the liquid developer. Further, since the color shift compensation mode is executed under the same condition as in the image forming mode provided in the image forming apparatus in terms of the removal amount of the carrier on the intermediate transfer member 40, it is possible to prevent deterioration in the cleaning performance of the cleaning blade for cleaning the resist marks transferred onto the intermediate transfer medium 40.

As a reference, an example of parameters in image forming processes in the first and second type recording medium image forming modes are shown in the following Table 6.

TABLE 6

| | | First type recording medium | | Second type recording medium | |
|---|---|---|---|---|---|
| | | Art paper | Coated paper | High-quality paper | Regular paper |
| Exposure process | Light amount [μJ/cm$^2$] | 0.7 | | 0.8 | |
| Charging process | Bias voltage [V] | 600 | | 700 | |
| Developing process | Bias voltage [V] | 450 | | 550 | |
| | Peripheral speed of anilox roller [mm/s] | 247 | | 420 | |

TABLE 6-continued

| | First type recording medium | | Second type recording medium | |
|---|---|---|---|---|
| | Art paper | Coated paper | High-quality paper | Regular paper |
| Developer film thickness [μm] | 6.5 | | 10 | |

There is a case where a mode (low-speed mode) in which the moving speed of the intermediate transfer member 40 and speed of various processes associated with the intermediate transfer member 40 are made lower than the speed of an ordinary printing speed in accordance with the paper type (especially, thickness of the paper) is provided. However, such a low-speed mode is not applied to the color shift compensation mode of the present invention. That is, in order to execute the color shift compensation mode, the moving speed of the intermediate transfer member 40 needs to be the same in each of a plurality of image forming modes provided in the image forming apparatus. This is because that the condition for the color shift compensation changes in accordance with the moving speed of the intermediate transfer member 40.

As a reference, an example of parameters in the low-speed mode image forming process is shown in the following Table 7.

TABLE 7

| | | Low-speed mode |
|---|---|---|
| Exposure process | Light amount [μJ/cm$^2$] | 0.65 |
| Charging process | Bias voltage [V] | 550 |
| Developing process | Bias voltage [V] | 400 |
| | Peripheral speed of anilox roller [mm/s] | 247 |
| | Developer film thickness [μm] | 6.5 |

Figure 9:
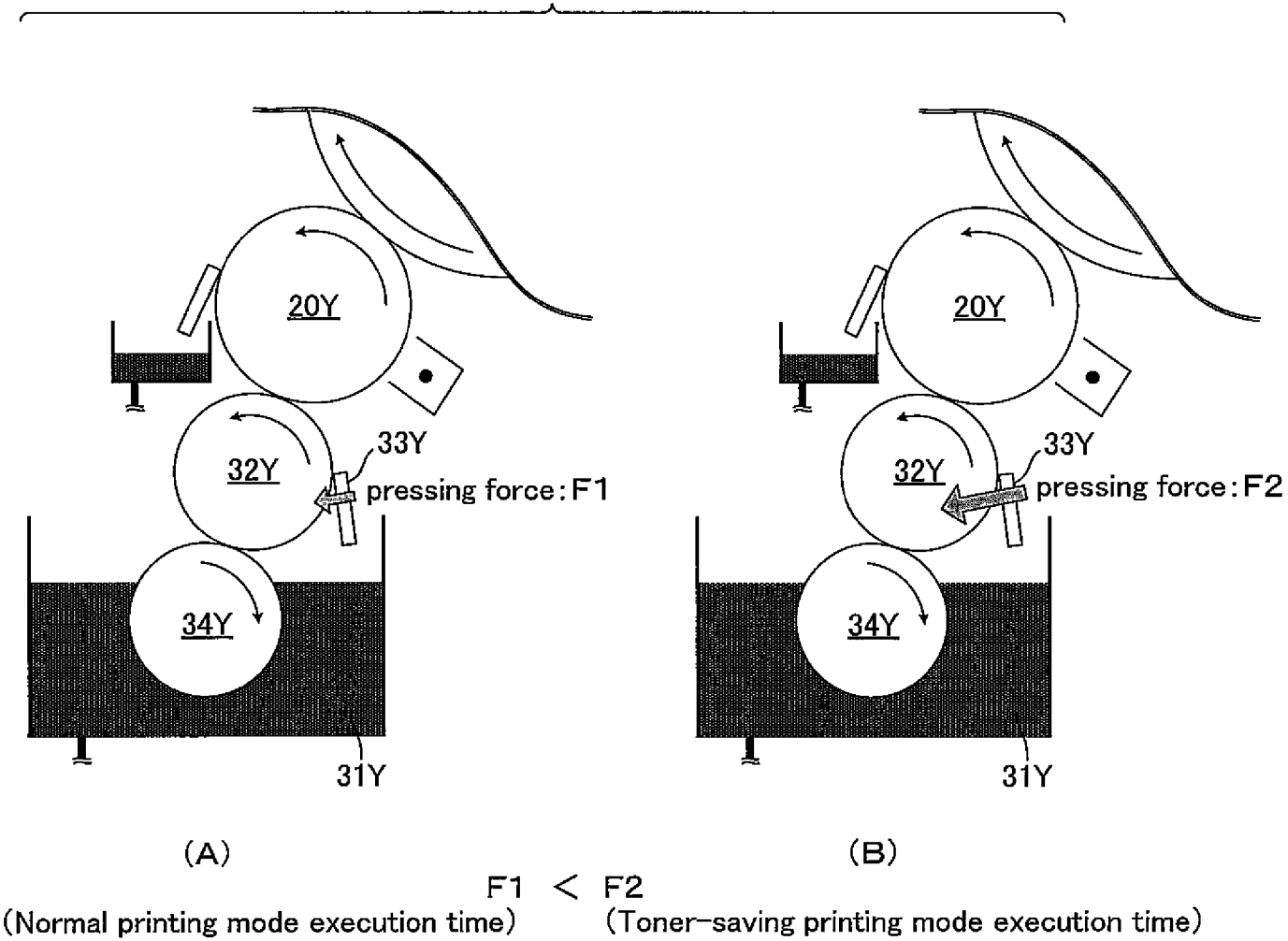
FIGS. 9A and 9B are views showing main components of a developing unit in the image forming apparatus according to a fifth embodiment of the present invention.
Figure 10:
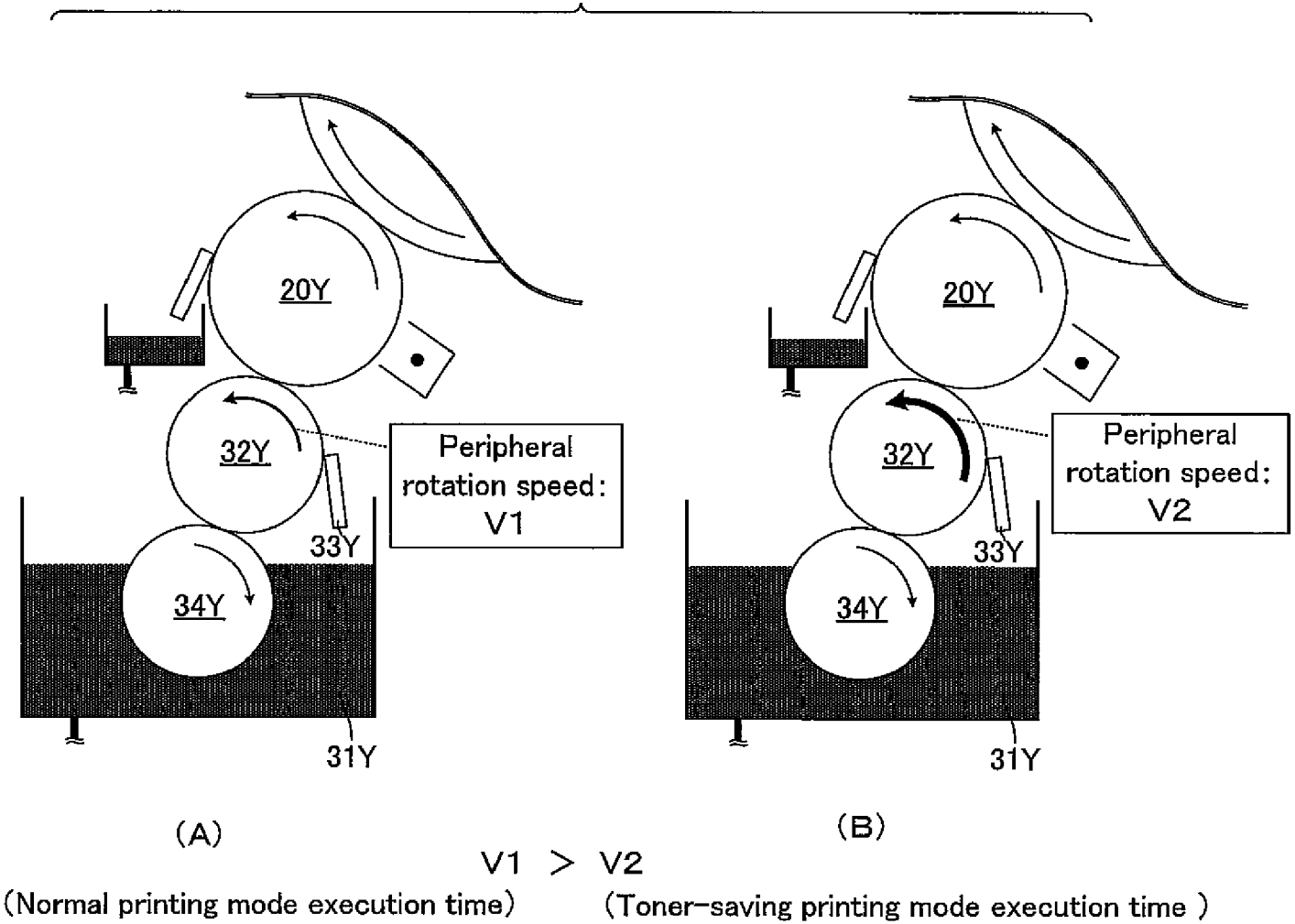
FIGS. 10A and 10B are another views showing main components of the developing unit in an image forming apparatus according to the fifth embodiment of the present invention.

Next, a fifth embodiment of the present invention will be described. FIGS. 9 and 10 are views showing main components of a developing unit in the image forming apparatus according to the fifth embodiment of the present invention. The present embodiment can be practiced in parallel with the embodiments described above.

In the color shift compensation mode of the present embodiment, the carrier contained in the resist marks is removed while the removal amount thereof is controlled so as not to be excessive. More specifically, as in the case of the above embodiments, the color shift compensation mode is executed under a condition of the same carrier removal amount as in the image forming mode in which the removal amount of the carrier on the intermediate transfer member 40 is largest of all the image forming modes provided in the image forming apparatus.

In the present embodiment, as a plurality of image forming modes provided in the image forming apparatus, those in which toner consumption amount for use in an image forming process differs from one another can be adopted. More specifically, the image forming apparatus according to the fifth embodiment has a normal printing mode and a toner-saving printing mode in which an image forming process is carried out with a smaller toner amount than in the normal printing mode.

In the toner-saving printing mode, the amount of a liquid developer supplied from the anilox roller 32 to the developing roller 20 is controlled to be reduced as compared to that in the normal printing mode. The carrier amount on the intermediate transfer member 40 is proportional to the supply of the liquid developer. Thus, in the present embodiment, the same carrier condition as in the toner-saving printing mode is applied to the color shift compensation mode.

A method of controlling the amount of the liquid developer supplied from the anilox roller 32 to developing roller 20 will be described with reference to FIGS. 9A and 9B by taking the developing unit of yellow as an example. Since the developing units of respective colors have the same configuration, only the developing unit of yellow will be described below.

In the example of FIGS. 9A and 9B, in order to control the amount of the liquid developer supplied from the anilox roller 32Y to developing roller 20Y, the pressing force of the restricting blade 33Y is changed. More specifically, assuming that the pressing force of the restricting blade 33Y in the normal printing mode is F1 and pressing force thereof in the toner-saving printing mode is F2, F2 is set larger than F1 to thereby reduce the amount of the liquid developer supplied from the anilox roller 32Y to developing roller 20Y at the execution time of the toner-saving printing mode.

Another method of controlling the amount of the liquid developer supplied from the anilox roller 32 to developing roller 20 will be described with reference to FIGS. 10A and 10B.

In the example of FIGS. 10A and 10B, in order to control the amount of the liquid developer supplied from the anilox roller 32Y to developing roller 20Y, the rotation speed of the anilox roller 32Y is changed. More specifically, assuming that the peripheral speed of the anilox roller 32Y in the normal printing mode is V1 and peripheral speed thereof in the toner-saving printing mode is V2, V1 is set larger than V2 to thereby reduce the amount of the liquid developer supplied from the anilox roller 32Y to developing roller 20Y at the execution time of the toner-saving printing mode.

The methods described using FIGS. 9 and 10 can be used in a combined manner so as to control the amount of the liquid developer supplied from the anilox roller 32Y to the developing roller 20Y.

In the manner as described above, the amount of the liquid developer supplied for the image forming process is reduced in the toner-saving printing mode as compared to that in the normal printing mode and, correspondingly, the carrier amount on the intermediate transfer member 40 is reduced. In the present embodiment, the same condition as in this toner-saving printing mode is applied to the color shift compensation mode.

As described above, according to the fifth embodiment of the present invention, since the color shift compensation mode is executed under the same condition as in the toner-saving printing mode in which the carrier amount on the intermediate transfer member 40 is reduced as compared to the carrier amount in the normal printing mode, the position information of the resist marks can be acquired without deterioration in the accuracy of the resist mark detection results obtained by the optical sensor, thereby achieving accurate color shift compensation. Further, since the color shift compensation mode is executed under the same condition as in the image forming mode provided in the image forming apparatus in terms of the amount of the carrier on the intermediate transfer member 40, it is possible to prevent deterioration in the cleaning performance of the cleaning blade for cleaning the resist marks transferred onto the intermediate transfer medium 40. That is, according to the present invention, there can be provided an image forming apparatus capable of achieving both the prevention of deterioration in the resist mark detection accuracy and prevention of deterioration in the cleaning performance with respect to the intermediate transfer member in a balanced manner.

As a reference, an example of parameters in the image forming process of the toner-saving printing mode is shown in the following Table 8.

TABLE 8

| | | Toner-saving mode |
|---|---|---|
| Exposure process | Light amount [μJ/cm$^2$] | 0.7 |
| Charging process | Bias voltage [V] | 600 |
| Developing process | Bias voltage [V] | 450 |
| | Peripheral speed of anilox roller [mm/s] | 213 |
| | Developer film thickness [μm] | 5.8 |

Figure 12:
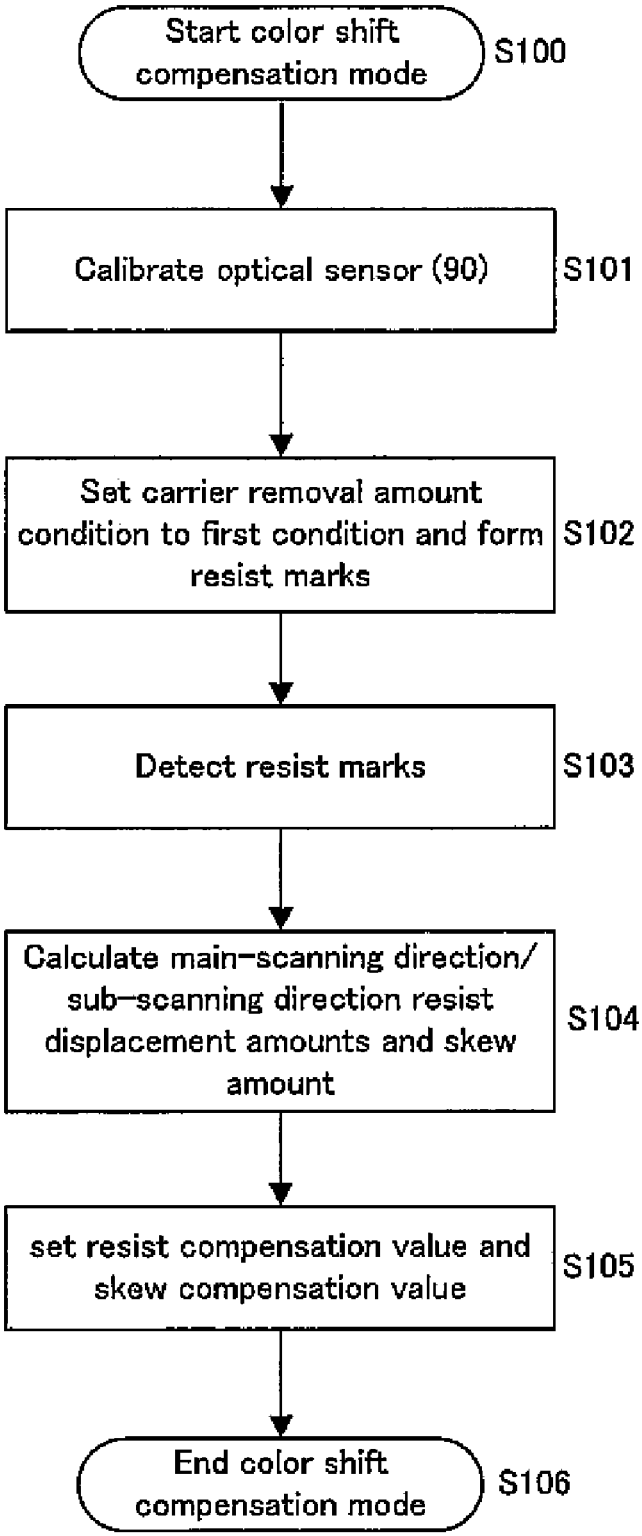
FIG. 12 is a view showing a flowchart of color shift compensation mode processing.

The processing performed in the color shift compensation mode will be described in more detail below. FIG. 12 is a view showing a flowchart of the color shift compensation mode processing. As shown in FIG. 12, after the start of the color shift compensation processing, calibration of the optical sensor 90 for detecting the resist marks are performed to adjust the light-emitting amount of the sensor such that the surface output of the intermediate transfer member 40 assumes a predetermined voltage. Then, the condition of the carrier removal amount is set to the first condition which is the same condition as in the first type recording medium image forming mode.

Subsequently, the resist marks are formed on the intermediate transfer member 40, and the formed resist marks are detected using the optical sensor 90. Main-scanning direction resist displacement amounts, sub-scanning direction resist displacement amounts, and skew amounts are calculated from the detection results of the resist marks and then, based on the calculated values, resist compensation amounts (the main-scanning direction resist compensation values, sub-scanning direction resist compensation values, and skew compensation values) are set for respective colors.

Figure 13:
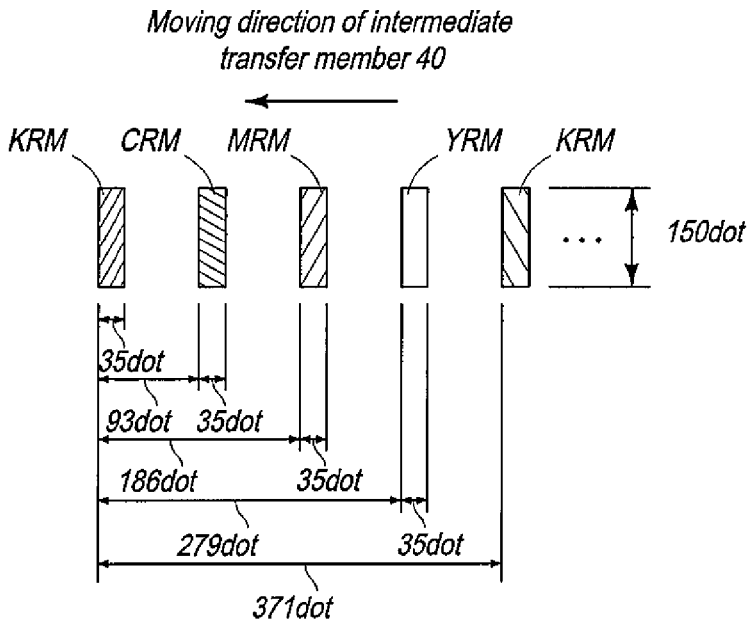
FIG. 13 is a view showing resist marks for sub-scanning direction resist displacement (skew amount) detection.
Figure 14:
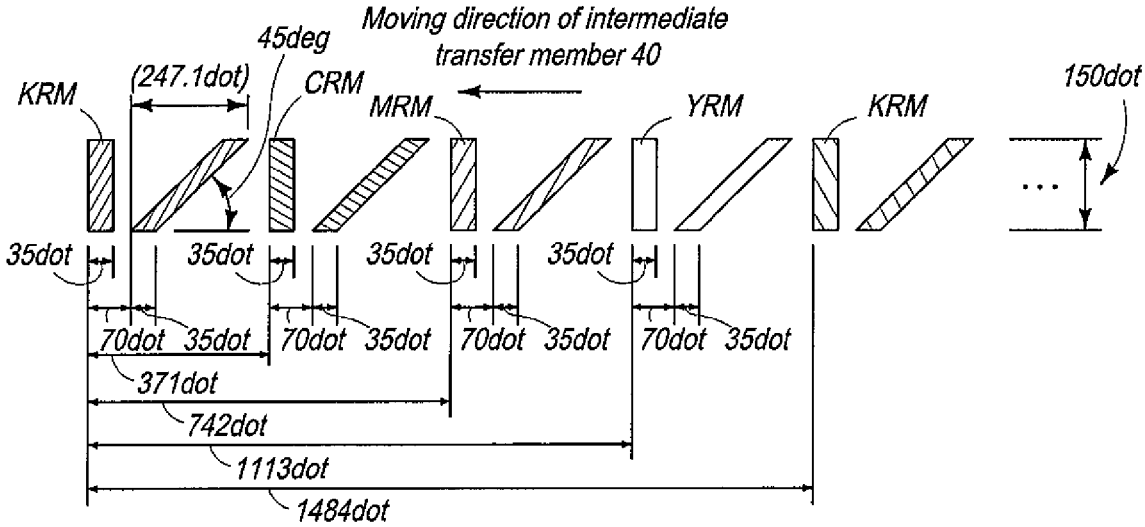
FIG. 14 is a view showing resist marks for main-scanning direction resist displacement detection.

Resist marks for sub-scanning direction resist displacement (skew amount) detection and resist marks for main-scanning direction resist displacement detection are shown in FIGS. 13 and 14, respectively.

(Resist Displacement Amount Calculation Method)

Calculation methods of the main-scanning direction resist displacement amount, sub-scanning direction resist displacement amount, and skew amount will be described. The resist displacement amount and skew amount for each color can be calculated from detection result (edge time information) of a predetermined resist mark. The following description is made for a case where K (black) is set as a reference color.

Main-Scanning Direction Displacement Amount Calculation Method

Figure 15:
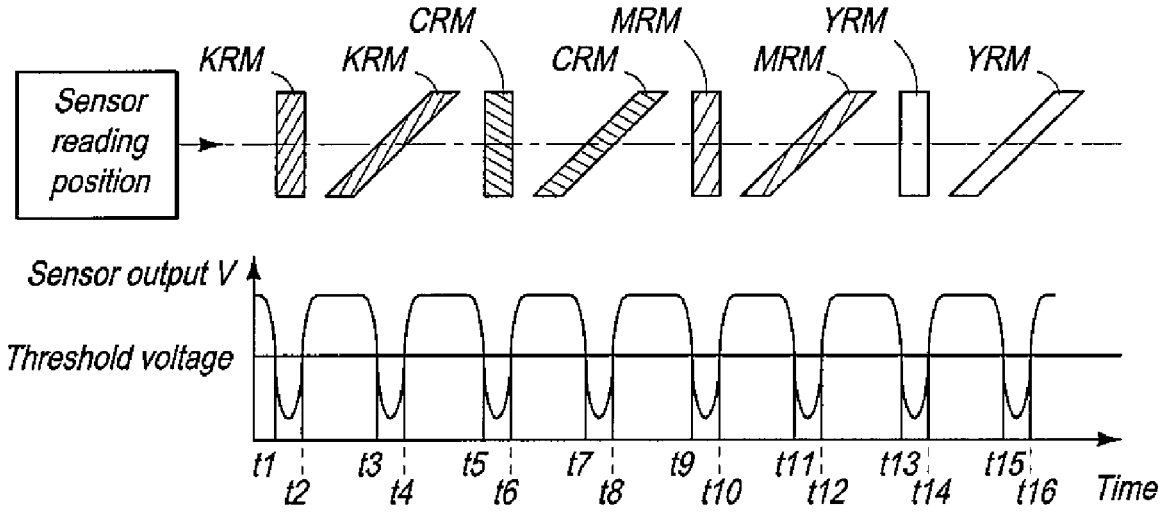
FIG. 15 is a view showing a sensor output observed when resist marks are detected by means of an optical sensor 90.

The main-scanning direction resist displacement amount can be calculated from a detection result of a mark obtained by combining a straight line and diagonal line. The following Table 9 explains an example of parameters when black (K) is set as a reference. FIG. 15 is a view showing a sensor output observed when resist marks are detected by means of the optical sensor 90.

TABLE 9

| | Time pitch between straight line and diagonal line (measurement value) | K-based resist displacement amount |
|---|---|---|
| Black (K) | Lk | — |
| Cyan (C) | Lc | Dc |
| Magenta (M) | Lm | Dm |
| Yellow (Y) | Ly | Dy |

First, the time pitches between the straight lines and diagonal lines of respective colors are calculated from the detection results of the resist marks, i.e., time information concerning the edges of the resist marks in the following manner.

$$Lk=\{(t3-t1)+(t4-t2)\}/2$$

$$Lc=\{(t7-t5)+(t8-t6)\}/2$$

$$Lm=\{(t11-t9)+(t12-t10)\}/2$$

$$Ly=\{(t15-t13)+(t16-t14)\}/2$$

Then, the main-scanning direction resist displacement amounts of respective colors with respect to the reference color (in this case, K) are calculated from the time pitches of the respective colors in the following manner.

$$Dc=Lc-Lk$$

$$Dm=Lm-Lk$$

$$Dy=Ly-Lk$$

Resist compensation values are set based on the resist displacement amounts and, based on the compensation values, the main-scanning direction light-emitting positions of the exposure units such as a line head (LED, OPH) other than the reference color are changed to compensate the main-scanning direction resist displacement.

Sub-Scanning Direction Displacement Amount Calculation Method

Figure 16:
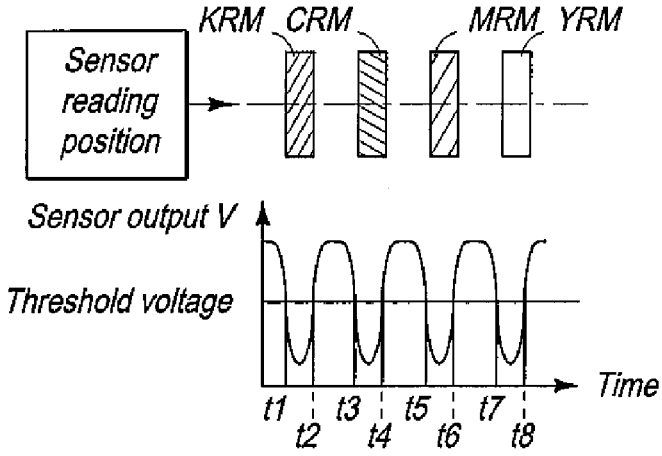
FIG. 16 is another view showing a sensor output observed when resist marks are detected by means of an optical sensor 90.

The sub-scanning direction resist displacement amount can be calculated from a detection result of a straight line mark. The following Table 10 explains an example of parameters when black (K) is set as a reference. FIG. 16 is a view showing a sensor output observed when resist marks are detected by means of the optical sensor 90.

TABLE 10

| | K-based time pitch (design vale) | K-based time pitch (measurement value) | K-based resist displacement amount |
|---|---|---|---|
| Cyan (C) | pc | Pc | Rc |
| Magenta (M) | pm | Pm | Rm |
| Yellow (Y) | py | Py | Ry |

First, the time pitches between the resist marks of the respective colors and that of the reference color are calculated from the detection results of the resist marks, i.e., time infor mation concerning the edges of the resist marks in the following manner.

$$Pc=((t3-t1)+(t4-t2))/2$$

$$Pm=((t5-t1)+(t6-t2))/2$$

$$Py=((t7-t1)+(t8-t2))/2$$

Then, the sub-scanning direction resist displacement amounts of respective colors are calculated from the time pitches of the respective colors and design values in the following manner.

$$Rc=Pc-pc$$

$$Rm=Pm-pm$$

$$Ry=Py-py$$

Resist compensation values are set based on the resist displacement amounts and, based on the compensation values, the sub-scanning direction light-emitting timings of the exposure units such as a line head (LED, OPH) other than the reference color are changed to compensate the sub-scanning direction resist displacement.

Skew Amount

Figure 17:
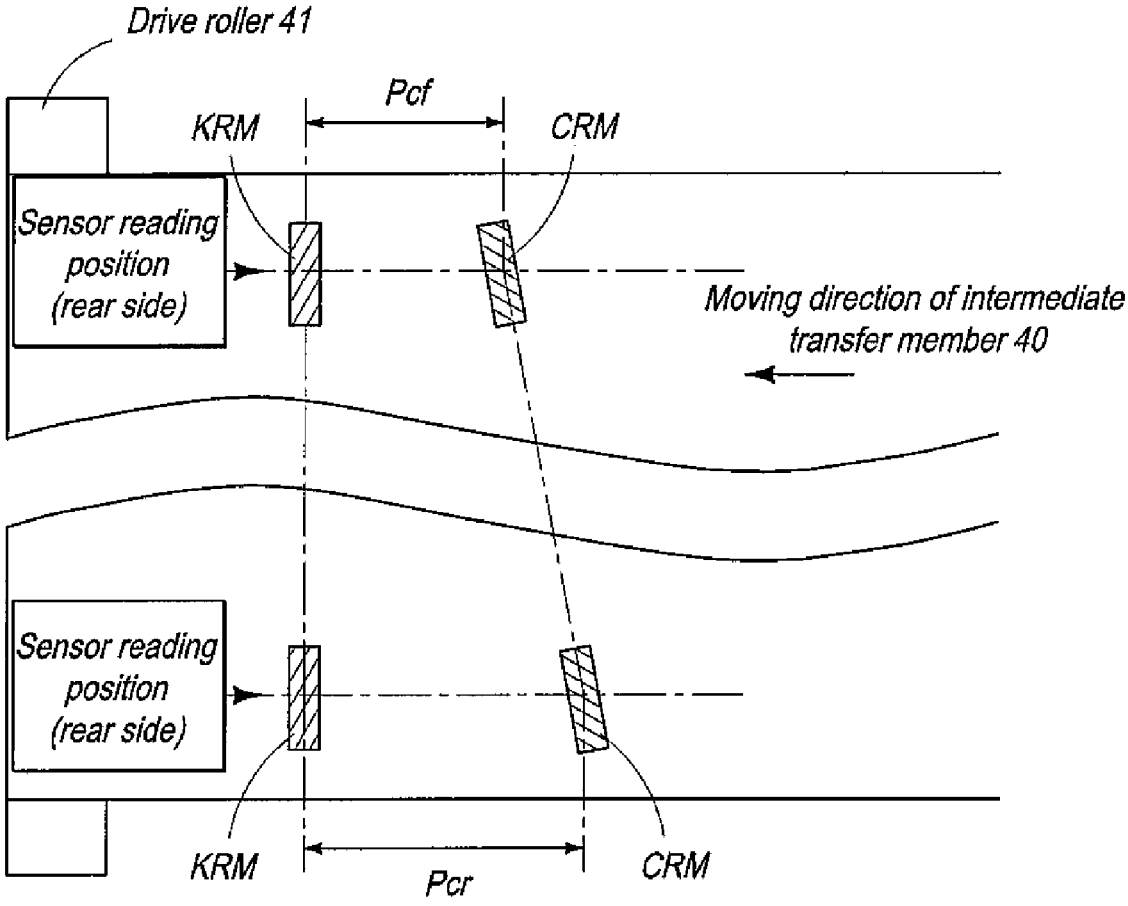
FIG. 17 is a view schematically showing a state where resist marks are detected by means of an optical sensor 90.

The skew amount of each color can be calculated from a detection result of sub-scanning direction resist marks formed on both ends of the intermediate transfer belt 41. The following table 11 explains an example of parameters when black (K) is set as a reference. FIG. 17 is a view schematically showing a state where resist marks are detected by means of an optical sensor 90. In this case, two sensor outputs from a front side sensor and rear side sensor provided on one side of the roller and the like in the shaft direction thereof are used.

TABLE 11

| | K-based time pitch (front side measurement value) | K-based time pitch (rear side measurement value) | K-based skew amount |
|---|---|---|---|
| Cyan (C) | Pcf | Pcr | Sc |
| Magenta (M) | Pcm | Pmr | Sm |
| Yellow (Y) | Pcy | Pyr | Sy |

The time pitches between the resist marks of the respective colors and that of the reference color are calculated from the time information concerning the edges of the resist marks which are obtained at both ends (front side and rear side) of the intermediate transfer member 40 in the direction perpendicular to the moving direction thereof, and the skew amounts are calculated based on a difference between the time pitches at the both ends of the intermediate transfer belt 41 in the following manner.

$$Sc=Pcf-Pcr$$

$$Sm=Pmf-Pmr$$

$$Sy=Pyf-Pyr$$

Skew compensation values are set based on the skew amounts and, based on the compensation values, the sub-scanning direction light-emitting timings of the exposure units such as a line head (LED, OPH) other than the reference color are changed for each chip or for each dot to compensate the skew.

Although the present invention has been described with reference to the various embodiments, an embodiment obtained by arbitrarily combining a part or all of the configurations of the above embodiments is included in the scope of the present invention.

What is claimed is:

1. An image forming apparatus comprising:

a first image carrier that carries a first latent image;

a first charging section that charges the first image carrier;

a first exposure section that exposes the first image carrier charged by the first charging section;

a first developing section that develops the first latent image formed on the first image carrier in the first exposure section using a first liquid developer containing a carrier and first toner particles;

a first primary transfer section that transfers a first image developed in the first developing section onto a transfer medium;

a second image carrier that carries a second latent image;

a second charging section that charges the second image carrier;

a second exposure section that exposes the second image carrier charged by the second charging section;

a second developing section that develops the second latent image formed on the second image carrier in the second exposure section using a second liquid developer containing the carrier and second toner particles;

a second primary transfer section that transfers a second image developed in the second developing section onto a transfer medium;

a carrier removal section of the transfer medium that removes the carrier from the first and second images transferred on the transfer medium;

a condition storage section that stores a first condition in which the carrier removal amount in the carrier removal section of the transfer medium is set to a first carrier removal amount and a second condition in which the carrier removal amount in the carrier removal section of the transfer medium is set to a second carrier removal amount smaller than the first carrier removal amount;

an optical sensor that detects the first and second images transferred on the transfer medium, from which the carrier has been removed under the first condition stored in the condition storage section; and a distance calculation section that calculates the distance between the first and second images detected by the optical sensor.

2. The image forming apparatus according to claim 1, wherein the carrier removal section of the transfer medium is a roller, and the rotation direction of the roller differs between the first and second conditions.

3. The image forming apparatus according to claim 1, comprising a second carrier removal section of the transfer medium that removes a carrier from the first image transferred on the transfer medium.

4. An image forming apparatus comprising:

a first image carrier that carries a first latent image;

a first charging section that charges the first image carrier;

a first exposure section that exposes the first image carrier charged by the first charging section;

a first developing section that develops the first latent image formed on the first image carrier in the first exposure section using a first liquid developer containing a carrier and first toner particles;

a carrier removal section of the first image carrier that removes the carrier from a first image developed in the first developing section;

a first primary transfer section that transfers the first image from which the carrier has been removed in the carrier removal section of the first image carrier onto a transfer medium;

a second image carrier that carries a second latent image;

a second charging section that charges the second image carrier;

a second exposure section that exposes the second image carrier charged by the second charging section;

a second developing section that develops the second latent image formed on the second image carrier in the second exposure section using a second liquid developer containing the carrier and second toner particles;

a carrier removal section of the second image carrier that removes the carrier from a second image developed in the second developing section;

a second primary transfer section that transfers the second image from which the carrier has been removed in the carrier removal section of the second image carrier onto a transfer medium;

a condition storage section that stores a first condition in which the carrier removal amount in the carrier removal section of the first image carrier or the carrier removal section of the second image carrier is set to a first carrier removal amount and a second condition in which the carrier removal amount in the carrier removal section of the first image carrier or the carrier removal section of the second image carrier is set to a second carrier removal amount smaller than the first carrier removal amount;

an optical sensor that detects the first image transferred on the transfer medium, from which the carrier has been removed in the carrier removal section of the first image carrier under the first condition stored in the condition storage section and second image transferred on the transfer medium, from which the carrier has been removed in the carrier removal section of the second image carrier under the first condition stored in the condition storage section; and a distance calculation section that calculates the distance between the first and second images detected by the optical sensor.

5. The image forming apparatus according to claim 4, wherein the carrier removal section of the first image carriers is roller, and the rotation direction of the roller differs between the first and second conditions.

6. The image forming apparatus according to claim 4, comprising a carrier removal section of the transfer medium that removes the carrier from the first and second images transferred on the transfer medium.

7. The image forming apparatus according to claim 4, comprising a second carrier removal section of the transfer medium that removes the carrier from the first image transferred on the transfer medium.

8. The image forming apparatus according to claim 4, comprising:

a second carrier removal section of the first image carrier that removes the carrier from the first image from which the carrier has been removed in the carrier removal section of the first image carrier; and a second carrier removal section of the second image carrier that removes the carrier from the second image from which the carrier has been removed in the carrier removal section of the second image carrier.

9. The image forming apparatus according to claim 8, wherein the second carrier removal section of the first image carrier abuts and separates thereon from the first image carrier, and the second carrier removal section of the second image carrier abuts and separates thereon from the second image carrier.

* * * * *